US011175037B2

(12) United States Patent
Zhou

(10) Patent No.: US 11,175,037 B2
(45) Date of Patent: Nov. 16, 2021

(54) MULTI-OUTLET CHANNEL COMBINATION GAS VALVE

(71) Applicant: NINGBO RICHEN ELECTRICAL APPLIANCE CO., LTD, Ningbo (CN)

(72) Inventor: Yin Zhou, Ningbo (CN)

(73) Assignee: Ningbo Richen Electrical Appliance Co., LTD, Ningbo (CN)

( * ) Notice: Subject to any disclaimer, the term of this patent is extended or adjusted under 35 U.S.C. 154(b) by 190 days.

(21) Appl. No.: 16/590,416

(22) Filed: Oct. 2, 2019

(65) Prior Publication Data

US 2020/0333003 A1 Oct. 22, 2020

(30) Foreign Application Priority Data

Apr. 19, 2019 (CN) ..... 201910319206.3
Apr. 19, 2019 (CN) ..... 201920542903.0

(51) Int. Cl.
*G05D 16/06* (2006.01)
*F23N 1/00* (2006.01)
*F23N 3/00* (2006.01)

(52) U.S. Cl.
CPC ..... *F23N 1/007* (2013.01); *F23N 1/005* (2013.01); *F23N 3/005* (2013.01); *F23N 2235/14* (2020.01); *F23N 2235/24* (2020.01)

(58) Field of Classification Search
CPC ..... F23N 1/042; F23N 1/045; F23N 3/002; F23N 3/005; F23N 3/065; F23N 3/06; F23N 2235/18; Y10T 137/87981
See application file for complete search history.

(56) References Cited

U.S. PATENT DOCUMENTS 4,830,039 A * 5/1989 Kelly ..... F23N 5/107 137/66
4,971,095 A * 11/1990 Kelly ..... F23N 1/005 137/66
6,029,705 A * 2/2000 Happe ..... F23N 5/107 137/630.19

FOREIGN PATENT DOCUMENTS

EP 3726138 A1 * 10/2020 ..... F24C 3/12

* cited by examiner

*Primary Examiner* — Reinaldo Sanchez-Medina
(74) *Attorney, Agent, or Firm* — Occhiuti & Rohlicek LLP

(57) ABSTRACT

A multi-outlet channel combination gas valve includes a valve body, a solenoid valve and a flow regulating mechanism. The valve body has a multiple of air outlets, at least two outlet channels formed between each air outlet and an air inlet of the valve body, a regulating port disposed in the at least two outlet channels, and the flow regulating mechanism can regulate the gas flow passing through each regulating port of the valve body at the same time, and a solenoid valve with a dual-coil electromagnet structure. When the valve is opened, a relatively larger current is passed, and then a very small current will be provided thereafter to maintain an operation by low power consumption. Therefore, this gas valve can be used without a mains power, and a low-level regulating structure is provided for presetting a low-level flow of each air outlet.

9 Claims, 20 Drawing Sheets

MULTI-OUTLET CHANNEL COMBINATION GAS VALVE

CROSS REFERENCE TO RELATED APPLICATIONS

This application claims the benefit under 35 USC § 119(a) of Chinese Patent Application 201910319206.3 filed Apr. 19, 2019 and Chinese Patent Application 201920542903.0 filed Apr. 19, 2019.

FIELD OF INVENTION

The present invention relates to a combination gas valve, in particular to the combination gas valve with a multiple of outlet channels.

BACKGROUND OF INVENTION

Description of the Related Art

Fireplace is a safe and high-efficient conventional heating device. In addition to the heating function, the fireplace can also be used as a decorative item with ornamental effect.

With the rapid development of production and living, people have an increasingly higher requirement for fireplace, and thus a new gas fireplace with a plurality of burners is introduced, wherein a gas valve used for such gas fireplace requires a plurality of air outlets to keep the height of flames of the burners of the fireplace to be consistent at any time, so as to regulate the flow of each air outlet synchronously while regulating the air flow of the gas valve. In addition, the fireplace often needs to be used in the absence of the mains electricity and also requires a less power consumption for the operation of the gas valve.

However, the flow regulation of the outlet channels of most conventional gas valves is usually carried out by using multiple sets of independent regulating mechanisms and a program setting to control the synchronization of regulating the plurality of air outlets. The way of using several independent mechanisms gives rise to a more complicated structure, a higher cost, an increased amount of driving components, and a larger power consumption.

SUMMARY OF THE INVENTION

Technical Problems to be Solved

It is a primary objective of the present invention to overcome the aforementioned drawbacks of the conventional gas valve by providing a multi-outlet channel combination gas valve capable of using a driving component to regulate the airflow of a plurality of outlet channels of the gas valve, and saving power by changing the current of the valve when the valve is opened and closed.

Technical Solution

To achieve the aforementioned and other objectives, the present invention provides a multi-outlet channel combination gas valve comprising a valve body, a solenoid valve and a flow regulating mechanism, characterized in that the valve body comprises an air inlet and a plurality of air outlets, and at least two outlet channels are formed between the plurality of air outlets and the air inlet, and a regulating port is formed in the at least two outlet channels, and each regulating port is disposed around the flow regulating mechanism, and the flow regulating mechanism is capable of controlling the gas flow of each regulating port at the same time. Wherein, the synchronous regulation of the gas flow of each regulating port as described above refers to a synchronous regulation carried out according to a certain proportion or regularity.

The valve body further comprises a valve sealing opening disposed at the air inlet, and a gas must pass through at least one valve sealing opening in order to flow from the air inlet to each air outlet.

The solenoid valve has a gasket installed thereto and coordinated with the valve sealing opening, so that the opening and closing of the gas intake of the gasket and the valve sealing opening can be controlled by the opening, closing, and pull-in of the solenoid valve.

The plurality of air outlets equals to two or more air outlets.

Further, the at least one outlet channel has a low-level outlet channel disposed therein, and configured to be parallel to the regulating port in the same outlet channel, and has a low-level regulating plug installed therein, and coupled to the valve body by a threaded connection, and the tail of the low-level regulating plug is in a specific shape such as a slotted or hex grooved shaped in order to screw the low-level regulating plug into a certain depth of valve body manually by a tool and change the gas flow passing through the low-level outlet channel.

Further, the flow regulating mechanism has a plunger rod and a press plate, and each regulating port has an adjustment rod installed therein, and the press plate has an adjustment rod indenter disposed thereon and configured to be corresponsive to at least one of the adjustment rods, and the head of the adjustment rod indenter is contacted with the tail of the adjustment rod, and a resetting device is installed between the adjustment rod and the valve body, and the plunger rod is pushed to regulate the gas flow passing through each regulating port at the same time.

Further, the head of the adjustment rod indenter is capable of adjusting the height with respect to a surface of the press plate to compensate the size discrepancy caused by a manufacturing error of the adjustment rod during the manufacturing process.

Further, the solenoid valve is of a dual-coil electromagnet structure, and the solenoid valve comprises a solenoid valve static coil assembly and a solenoid valve dynamic coil assembly, and the solenoid valve dynamic coil assembly is coupled to a gasket, and a solenoid valve spring is installed between the gasket and the solenoid valve dynamic coil assembly. When the solenoid valve is switched from closing to opening, a larger current is passed. After the opening of the solenoid valve, a smaller current is applied instead to maintain the solenoid valve at an opening status.

Further, there may be one or more solenoid valves, and the configuration and assembly of the solenoid valve in the valve body can achieve the effect of controlling the opening and closing of the gas intake of various different outlet channels in the valve body.

Further, the valve body further comprises a dual-coil electromagnet type air outlet, and there are two or more solenoid valves including a whole solenoid valve and at least one divided solenoid valve, and there are also two or more corresponding valve sealing openings on the valve body, and these openings are called a whole valve sealing opening, a primary valve sealing opening and/or an auxiliary valve sealing opening, wherein the whole solenoid valve controls the opening and closing of the whole valve sealing opening, and the divided solenoid valve controls the opening and closing of the primary valve sealing opening and/or the auxiliary valve sealing opening, and the configuration and assembly of the divided solenoid valve in the valve body can achieve the effect of controlling the opening and closing of various different outlet channels in the valve body, and the pilot air outlet is disposed behind the whole valve sealing opening and in front of the primary valve sealing opening and/or the auxiliary valve sealing opening.

Further, the low-level regulating plug has a low-level regulating plug seal ring used for the sealing between the low-level regulating plug and the valve body, and the head of the low-level regulating plug is configured to be a primary conical head, so that the gas flow passing through the low-level outlet channel can be regulated more smoothly and gradually.

Beneficial Effects

Compared with the prior art, the present invention has the following advantages:

In the present invention, a multi-outlet channel gas valve is provided to supply gas to a multiple of burners of a gas fireplace, and each gas supply channel of the gas valve has a synchronous gas regulation far a low-level regulation, so that the invention features a simple structure and a low power consumption, and this invention is applicable for most gas fireplaces that require to control several burners.

Figure 13:
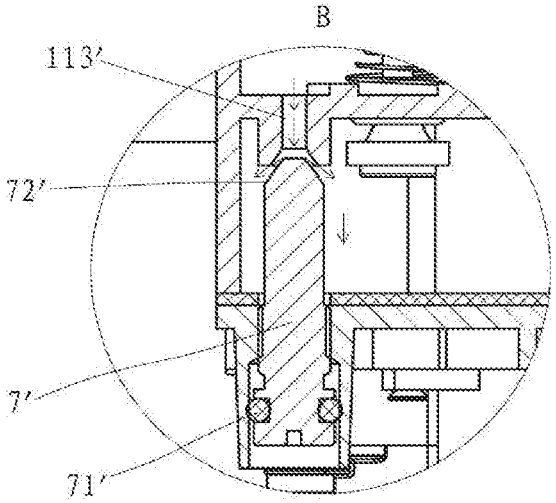
Figure 14:
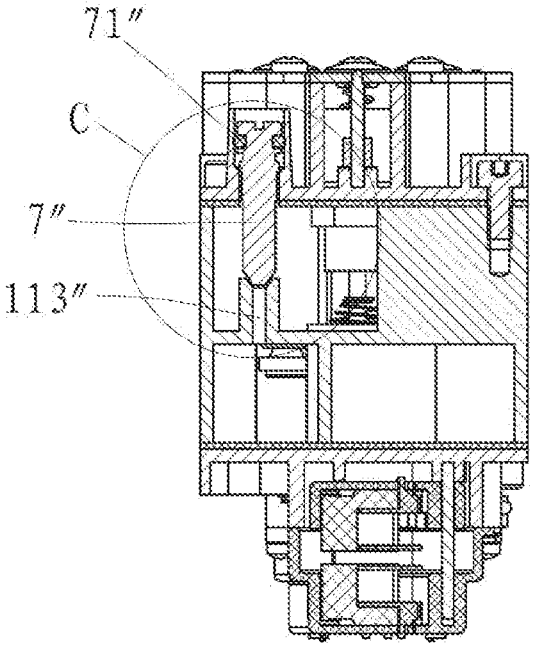
Figure 15:
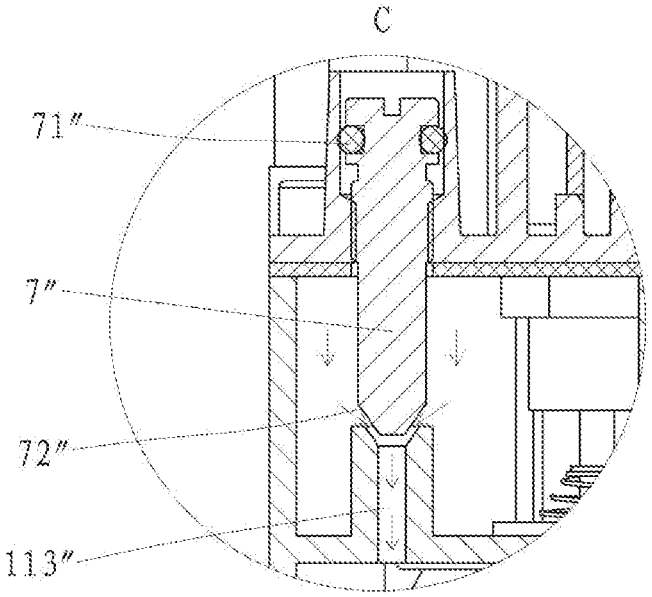
Figure 16:
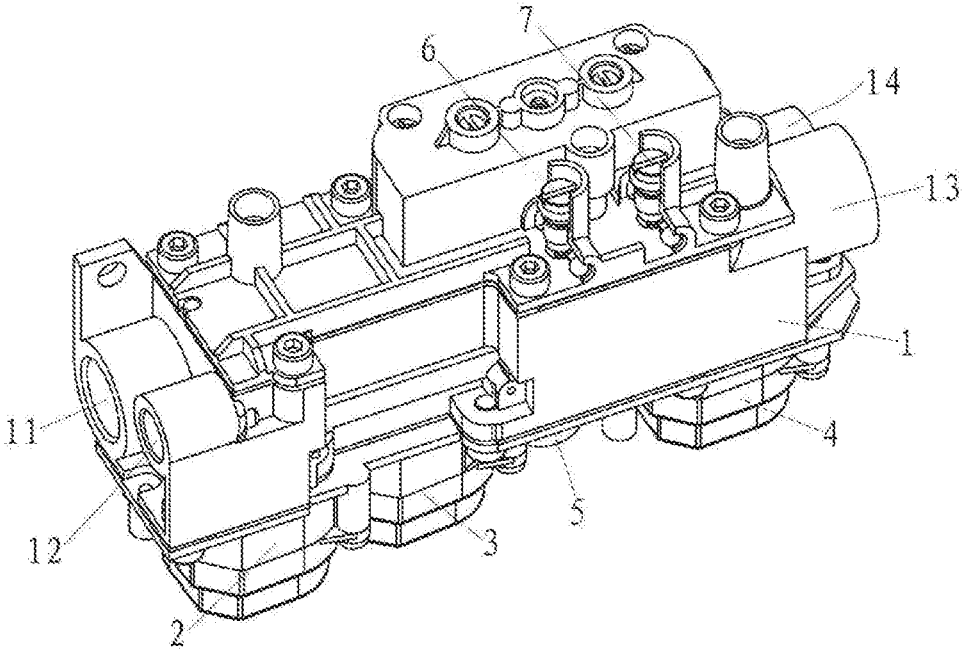
Figure 17:
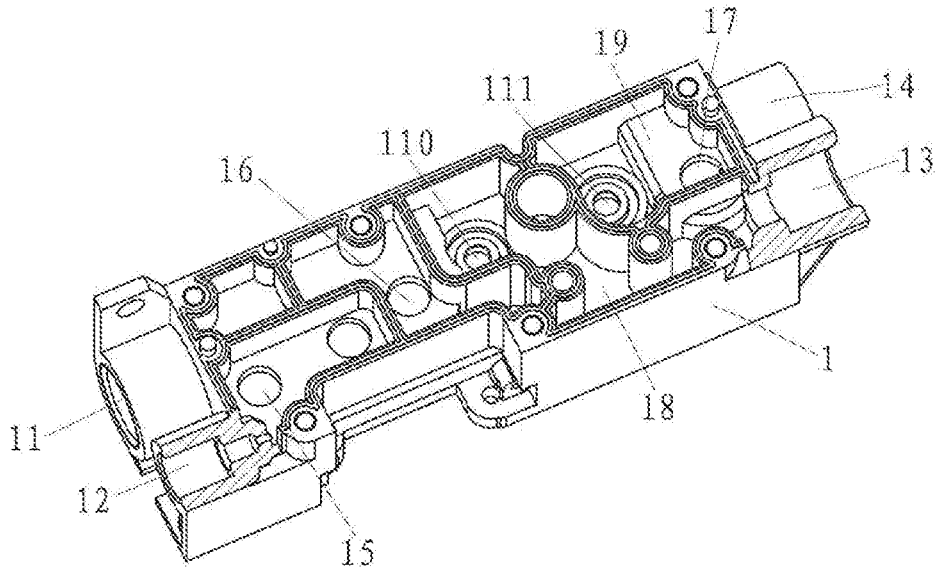
Figure 18:
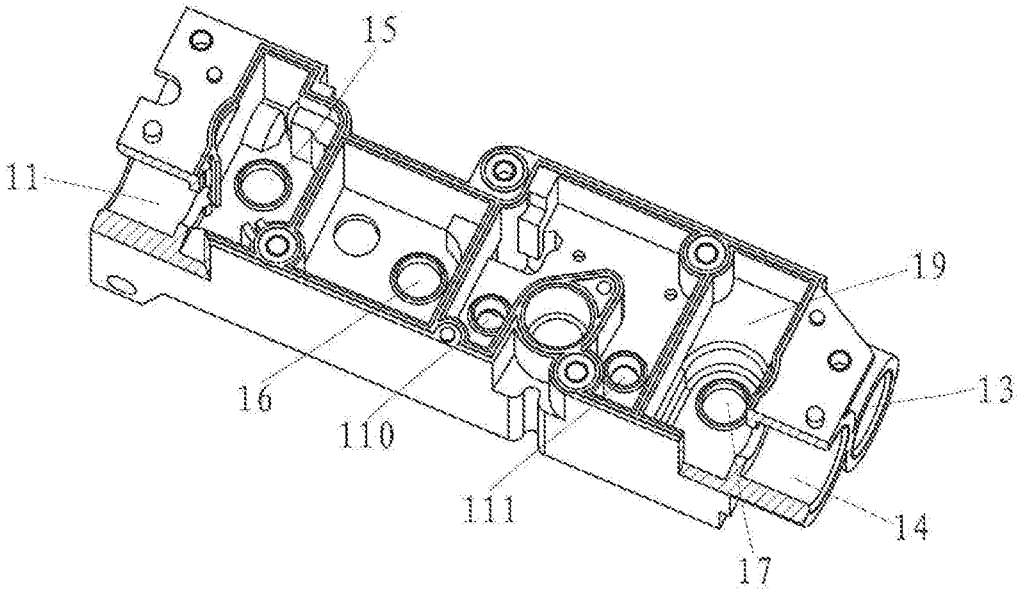
Figure 19:
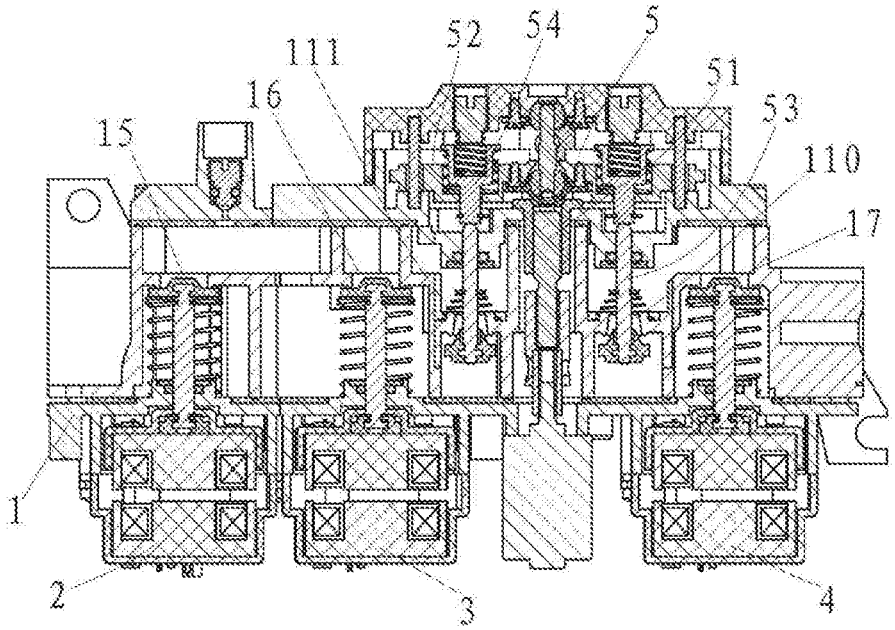
Figure 20:
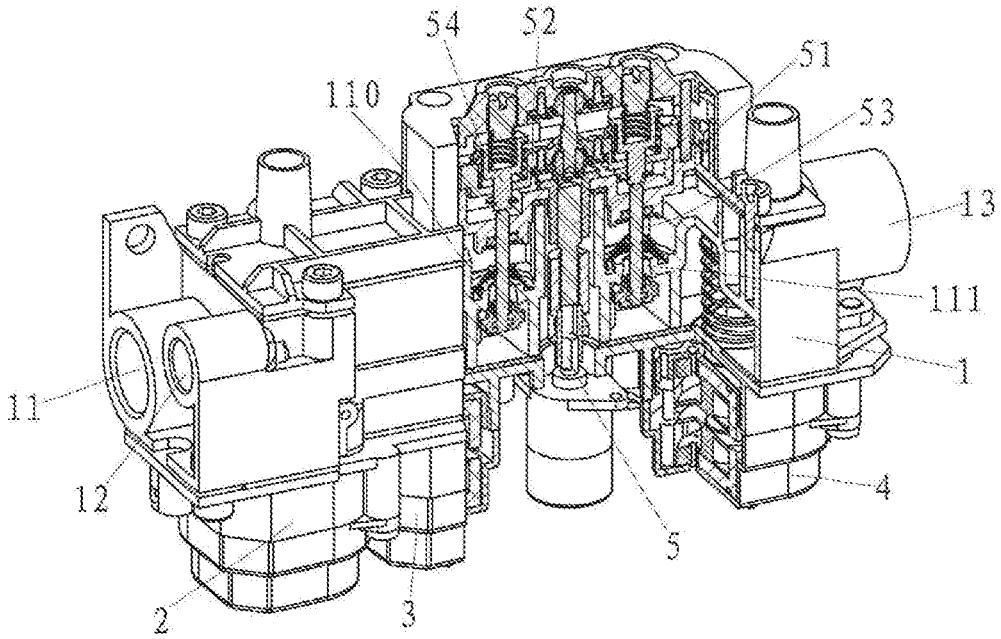
Figure 21:
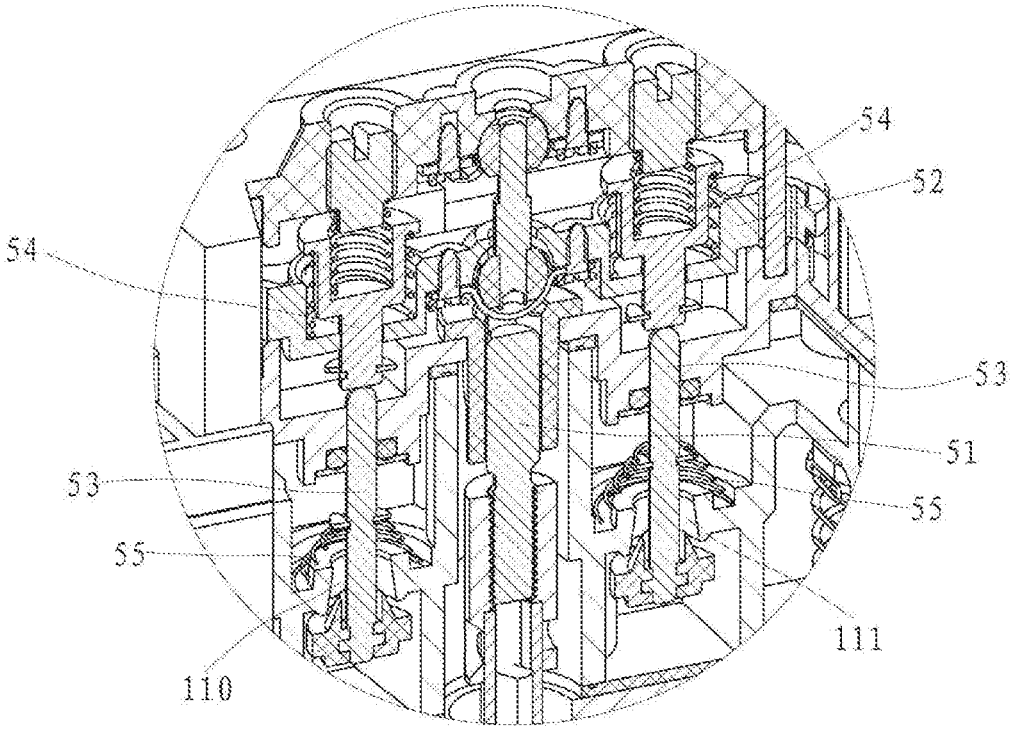
Figure 22:
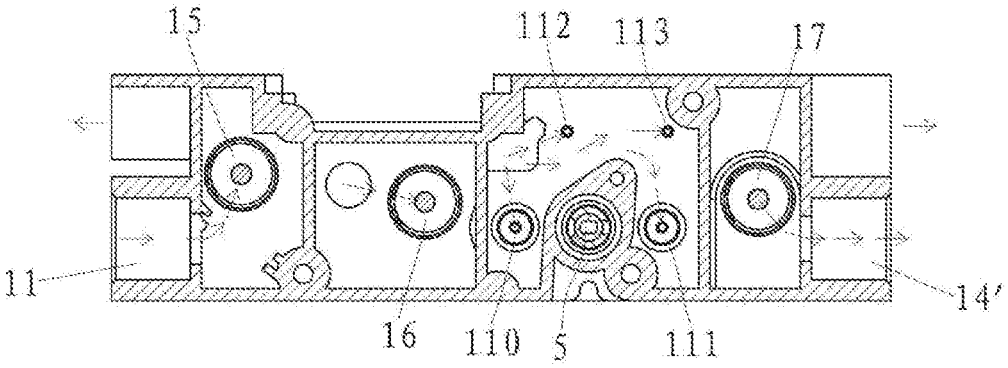
Figure 23:
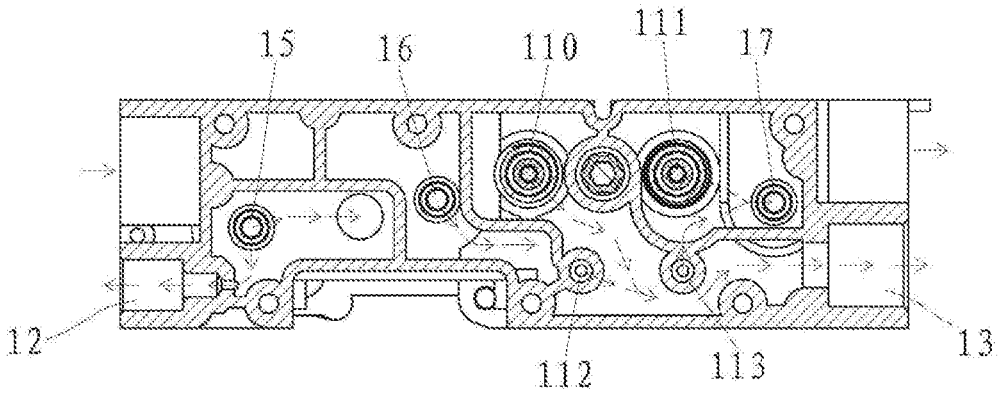
Figure 24:
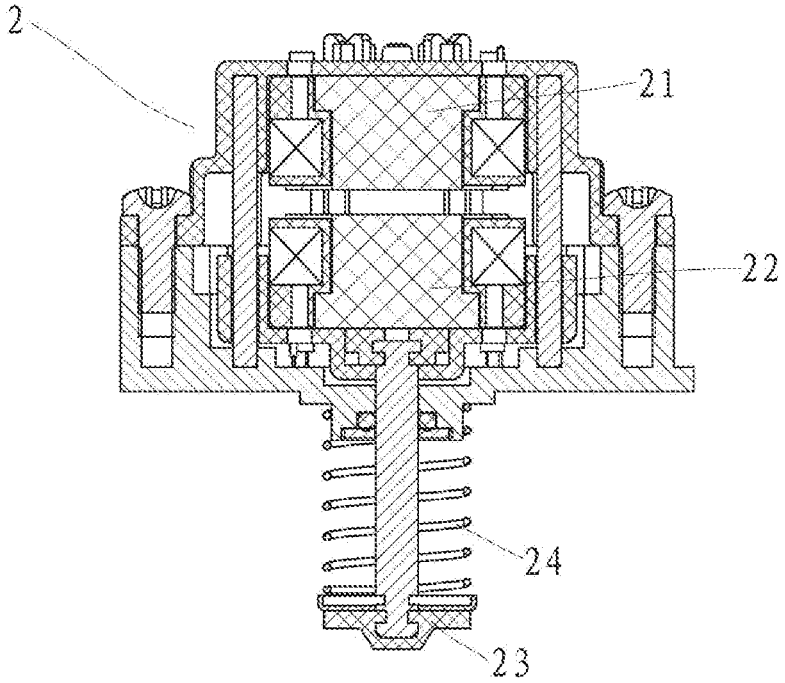
Figure 25:
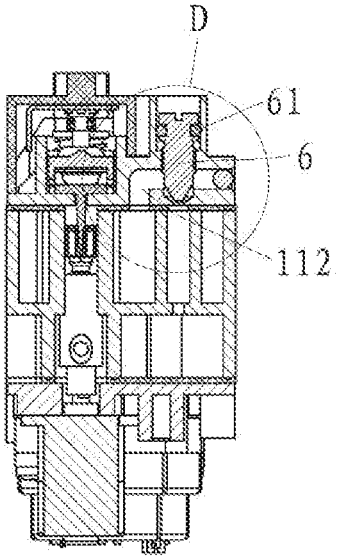
Figure 26:
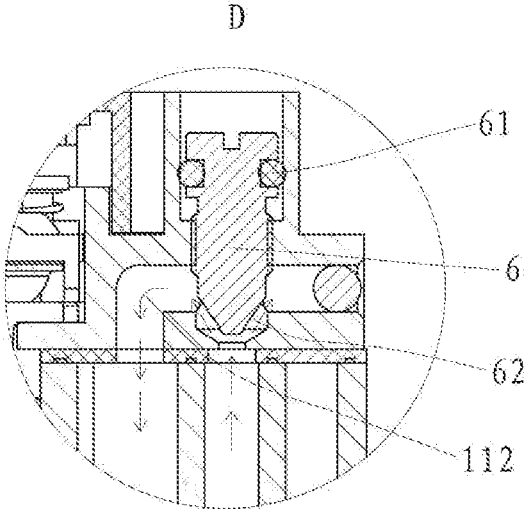
Figure 27:
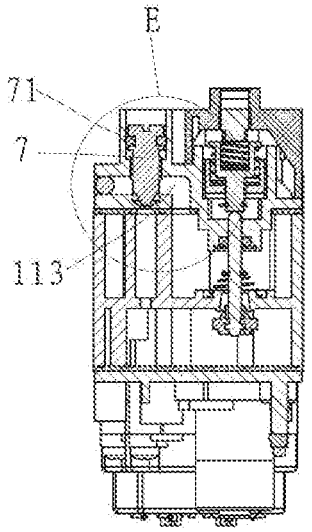
Figure 28:
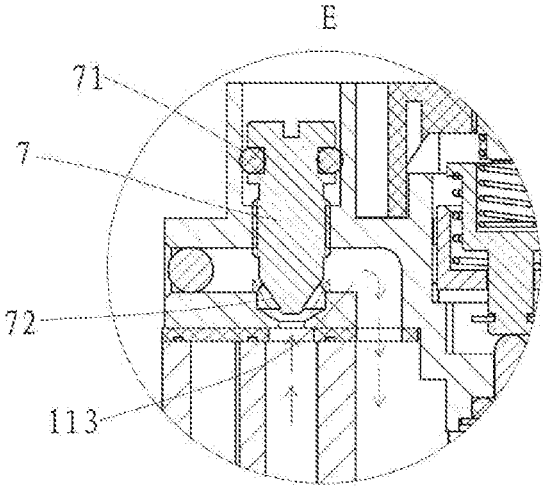
Figure 29:
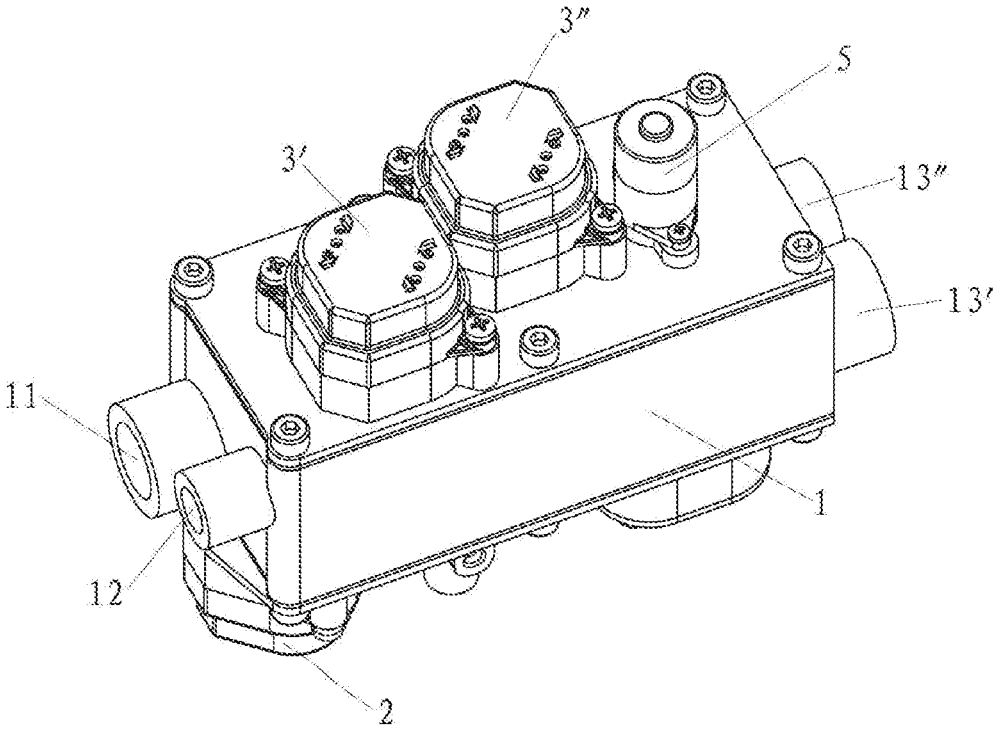
Figure 30:
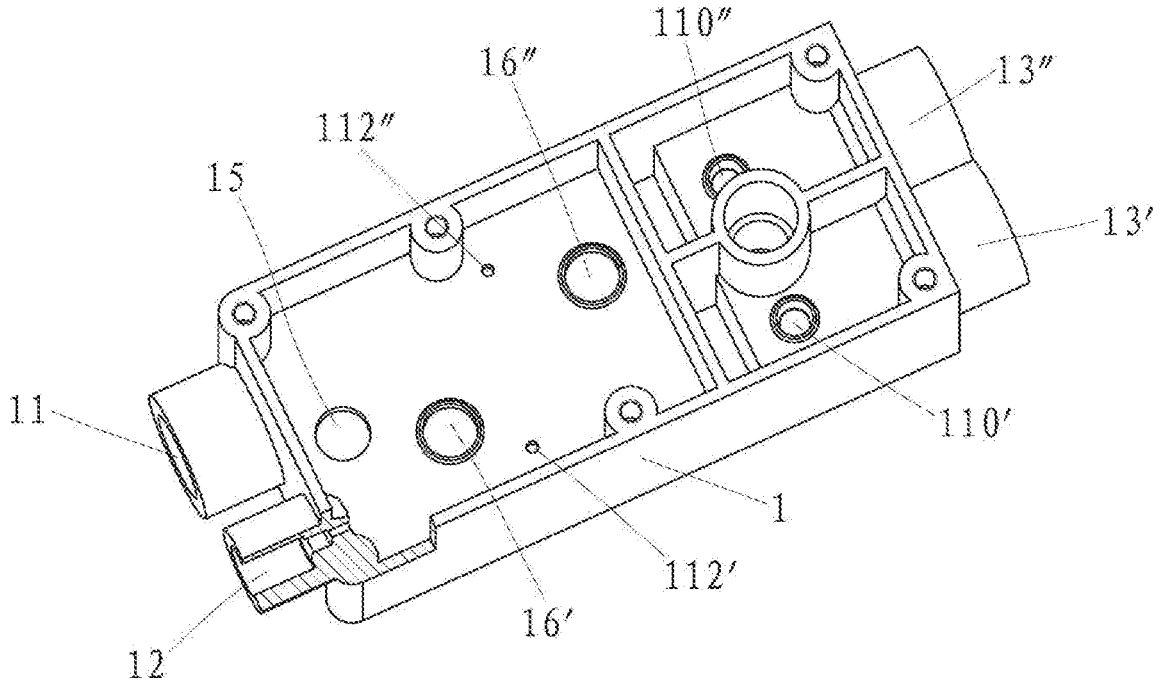
Figure 31:
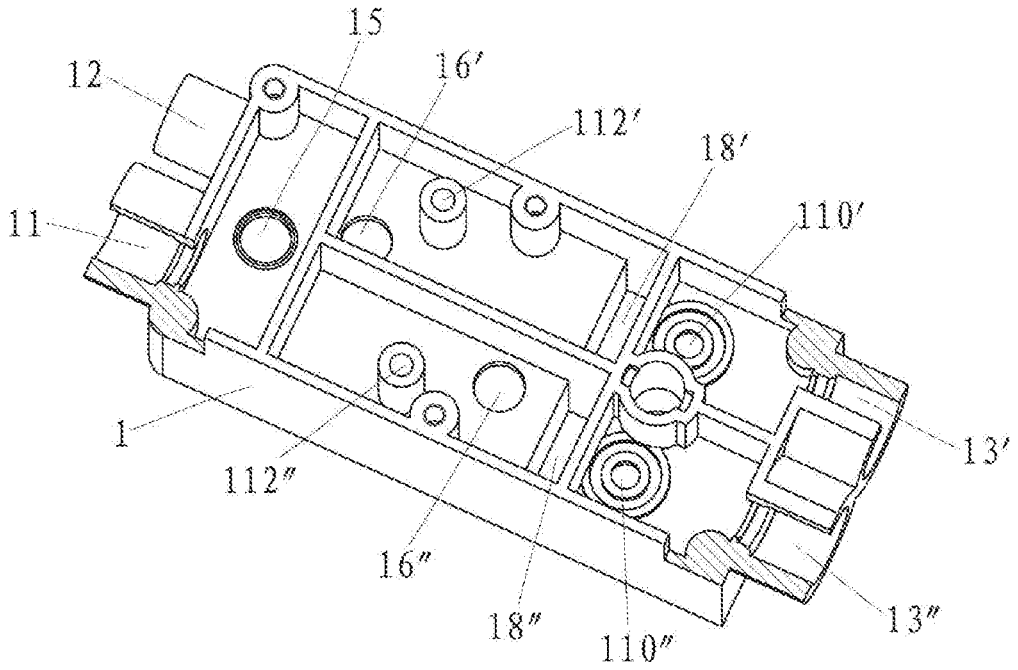
Figure 32:
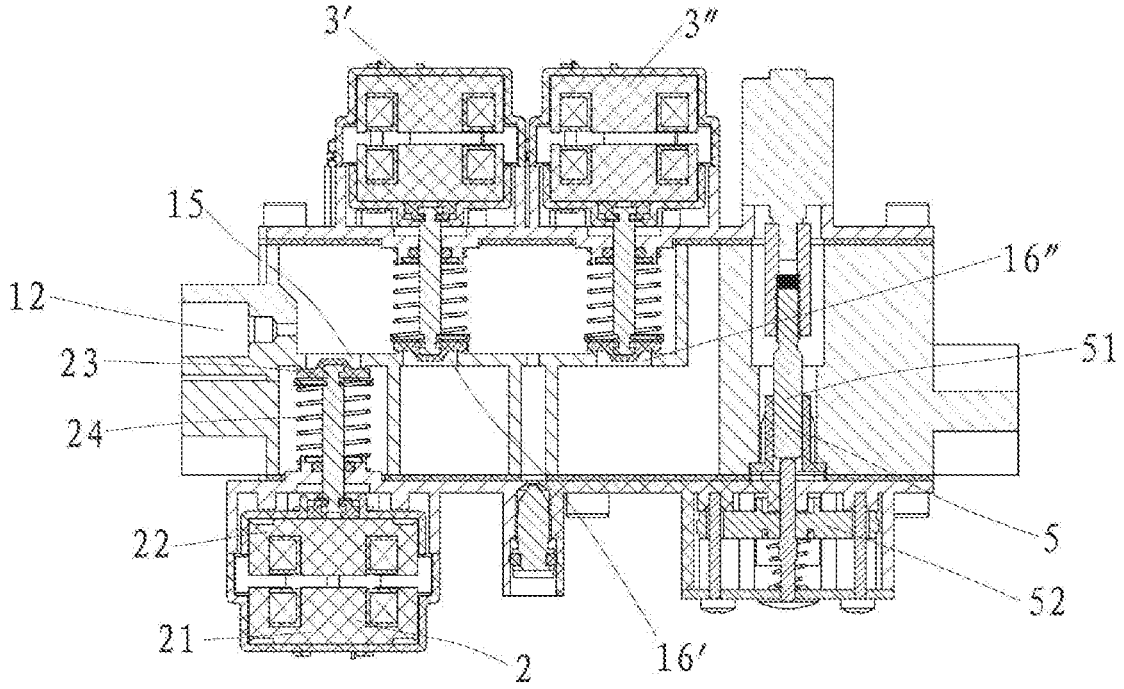
Figure 33:
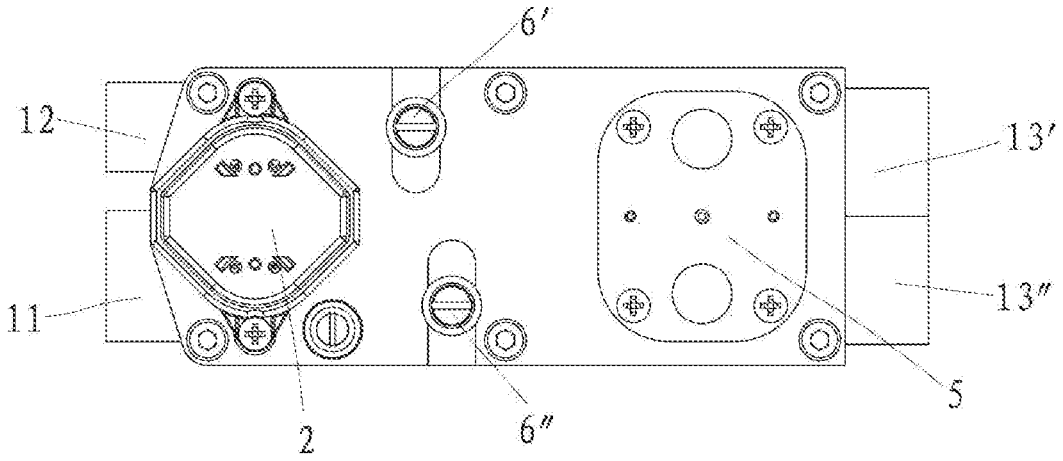
Figure 34:
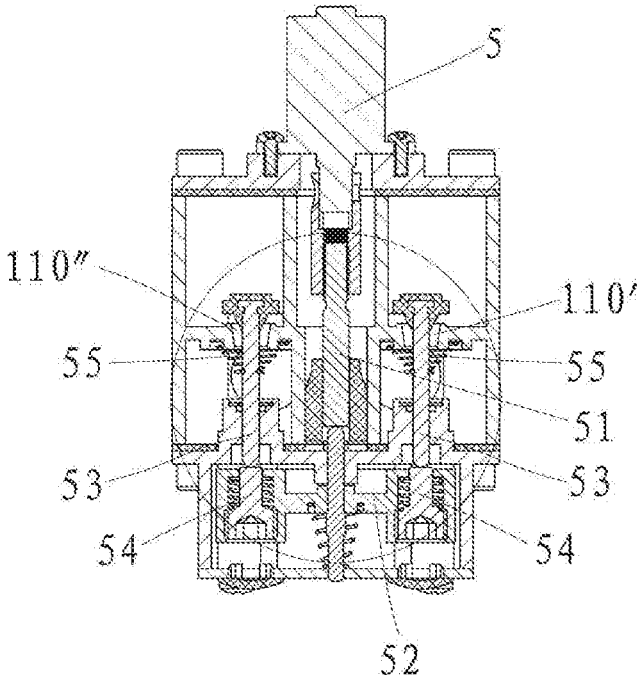
Figure 35:
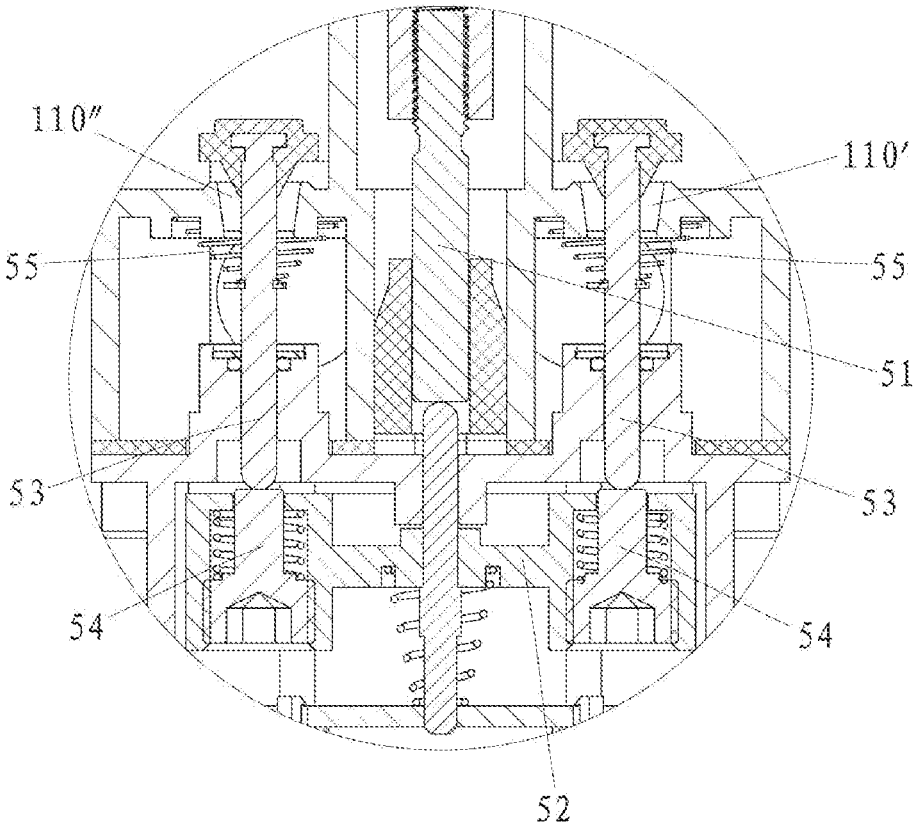
Figure 36:
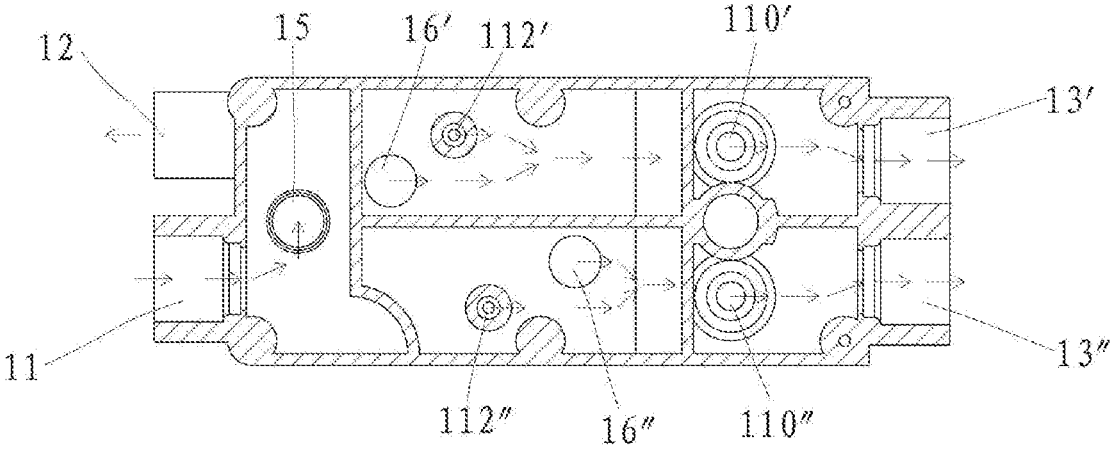
Figure 37:
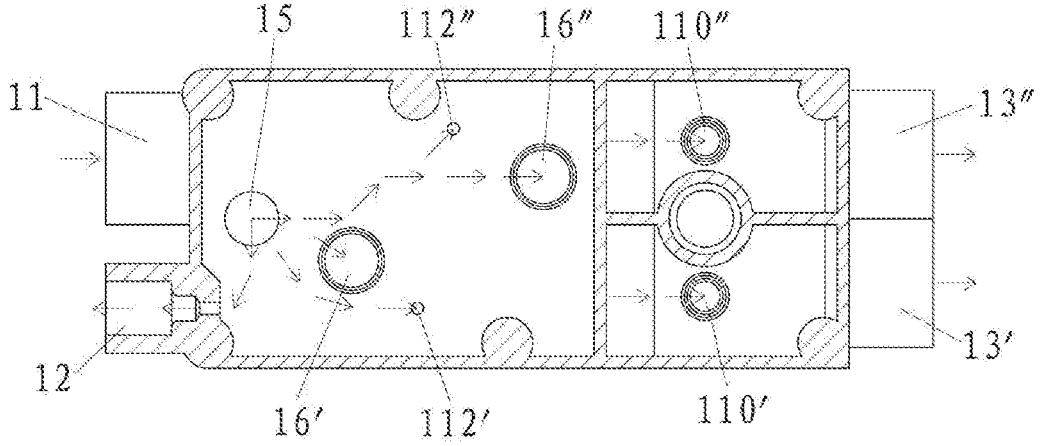
Figure 38:
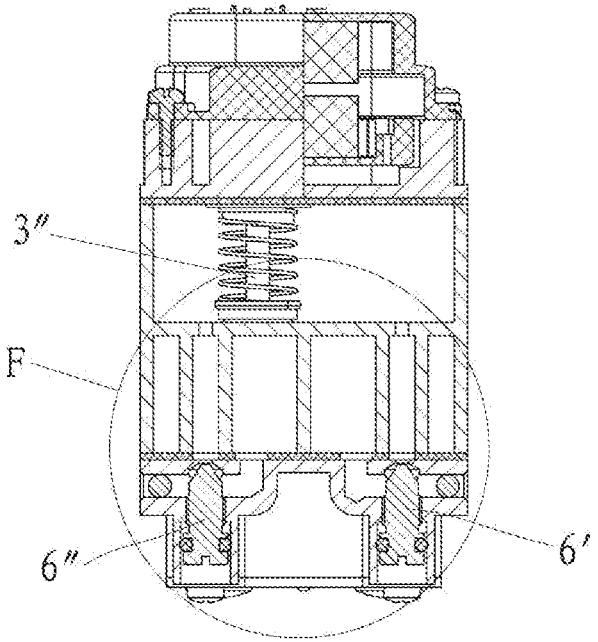
Figure 39:
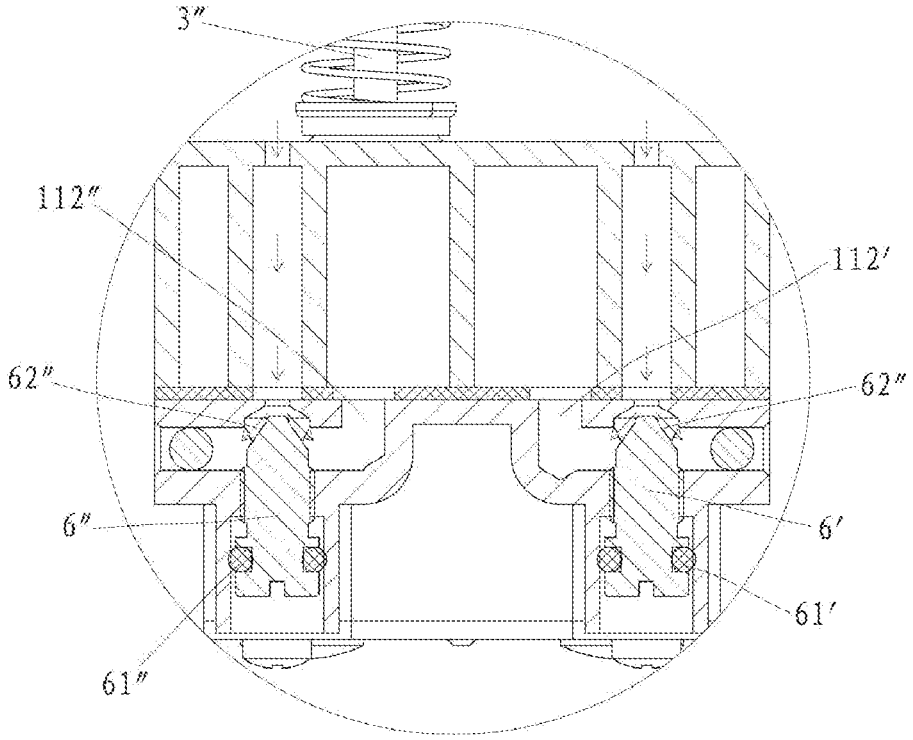

FIG. is a blowup view of Section A of the primary low-level regulating plug in accordance with the first embodiment of the present invention;

FIG. 13 is a blowup view of Section B of the first secondary low-level regulating plug in accordance with the first embodiment of the present invention;

FIG. 14 is a cross-sectional view of the second secondary low-level regulating plug in accordance with the first embodiment of the present invention;

FIG. 15 is a blowup view of Section C of the second secondary low-level regulating plug in accordance with the first embodiment of the present invention;

FIG. 16 is a schematic view of a second embodiment of the present invention;

FIG. 17 is a schematic view of a valve body in accordance with the second embodiment of the present invention;

FIG. 18 is a schematic view showing another side of the valve body in accordance with the second embodiment of the present invention;

FIG. 19 is a stepped cross-sectional view showing an initial position of the second embodiment of the present invention;

FIG. 20 is an axial-side partial sectional view of the second embodiment of the present invention;

FIG. 21 is a blowup view of a flow regulating mechanism in accordance with the second embodiment of the present invention;

FIG. 22 is a transverse sectional view of an air inlet in accordance with the second embodiment of the present invention;

FIG. 23 is a transverse sectional view of a primary air outlet in accordance with the second embodiment of the present invention;

FIG. 24 is a blowup view of a solenoid valve in accordance with the second embodiment of the present invention;

FIG. 25 is a stepped sectional view of a primary low-level regulating plug in accordance with the second embodiment of the present invention;

FIG. 26 is a blowup view of Section D of the primary low-level regulating plug in accordance with the second embodiment of the present invention;

FIG. 27 is a cross-sectional view of a secondary low-level regulating plug in accordance with the second embodiment of the present invention;

FIG. 28 is a blowup view of Section E of the secondary low-level regulating plug in accordance with the second embodiment of the present invention;

FIG. 29 is a schematic view of a third embodiment of the present invention;

FIG. 30 is a schematic view of a valve body in accordance with the third embodiment of the present invention;

FIG. 31 is a schematic view showing another side of the valve body in accordance with the third embodiment of the present invention;

FIG. 32 is a stepped sectional view of an initial position of the third embodiment of the present invention;

FIG. 33 is a top view of the third embodiment of the present invention;

FIG. 34 is a longitudinal sectional view of a flow regulating mechanism in accordance with the third embodiment of the present invention;

FIG. 35 is a blowup view of the flow regulating mechanism in accordance with the third embodiment of the present invention;

FIG. 36 is a transverse sectional view of an air inlet in accordance with the third embodiment of the present invention;

FIG. 37 is a transverse sectional view of a primary air outlet in accordance with the third embodiment of the present invention;

FIG. 38 is a stepped sectional view of a primary low-level regulating plug in accordance with the third embodiment of the present invention; and FIG. 39 is a blowup view of Section F of the primary low-level regulating plug in accordance with the third embodiment of the present invention.

BRIEF DESCRIPTION OF NUMERALS IN THE DRAWINGS

1—valve body; 2—whole solenoid valve; 3—primary divided solenoid valve (3'—first primary divided solenoid valve; 3"—second primary divided solenoid valve); 4—auxiliary divided solenoid valve (first auxiliary divided solenoid valve 4', second auxiliary divided solenoid valve 4"); 5—flow regulating mechanism; 6—primary low-level regulating plug (6'—first primary low-level regulating plug; 6"—second primary low-level regulating plug); 7—secondary low-level regulating plug (7'—first secondary low-level regulating plug; 7"—second secondary low-level regulating plug); 11—air inlet; 12—pilot air outlet; 13—primary air outlet (13'—first primary air outlet; 13"—second primary air outlet); 14—secondary air outlet (14'—first secondary air outlet; 14"—second secondary air outlet); 15—whole valve sealing opening; 16—primary valve sealing opening (16'—first primary valve sealing opening; 16"—second primary valve sealing opening); 17—auxiliary valve sealing opening (17'—first auxiliary valve sealing opening; 17"—second auxiliary valve sealing opening); 18—primary outlet channel (18'—first primary outlet channel; 18"—second primary outlet channel); 19—secondary outlet channel (19'—first secondary outlet channel; 19"—second secondary outlet channel); 110—primary regulating port (110'—first primary regulating port; 110"—second primary regulating port); 111—secondary regulating port (111'—first secondary regulating port; 111"—second secondary regulating port); 112—primary low-level outlet channel (112'—first primary low-level outlet channel; 112"—second primary low-level outlet channel); 113—secondary low-level outlet channel (113'—first secondary low-level outlet channel; 113"—second secondary low-level outlet channel); 21—solenoid valve static coil assembly; 22—solenoid valve dynamic coil assembly; 23—solenoid valve gasket; 24—solenoid valve spring; 51—plunger rod; 52—press plate; 53—adjustment rod; 54—adjustment rod indenter; 55—resetting device; 61—primary low-level regulating seal ring (61'—first primary low-level regulating seal ring; 61"—second primary low-level regulating seal ring); 62—primary low-level regulating plug conical head (62'—first primary low-level regulating plug conical head; 62"—second primary low-level regulating plug conical head); 71—secondary low-level regulating seal ring (71'—first secondary low-level regulating seal ring, 71" second secondary low-level regulating seal ring); and 72—secondary low-level regulating plug conical head (72'—first secondary low-level regulating plug conical head; 72"—second secondary low-level regulating plug conical head).

DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Embodiment 1

With reference to FIGS. 1 to 15 for a multi-outlet channel combination gas valve in accordance with the first embodiment of the present invention, the multi-outlet channel combination gas valve comprises a valve body 1, a solenoid valve and a flow regulating mechanism 5, characterized in that there are four solenoid valves called a whole solenoid valve 2, a primary divided solenoid valve 3, and an auxiliary divided solenoid valve 4 according to the effect of each solenoid valve in the gas path, wherein both of the primary divided solenoid valve 3 and the auxiliary divided solenoid valve 4 are divided solenoid valves, and the valve body 1 comprises an air inlet 11 and a pilot air outlet 12 as well as a plurality of air outlets which are divided into a primary air outlet 13 and two secondary air outlets 14 according to the outlet control method of each air outlet, and the two secondary air outlets 14 are called a first secondary air outlet 14' and a second secondary air outlet 14", and the two auxiliary divided solenoid valves 4 are called a first auxiliary divided solenoid valve 4' and a second auxiliary divided solenoid valve 4" and there are a whole valve sealing opening 15, a primary valve sealing opening 16 and an auxiliary valve sealing opening 17. In this embodiment, the auxiliary valve sealing opening 17 is also divided into a first auxiliary valve sealing opening 17' and a second auxiliary valve sealing opening 17", and the pilot air outlet 12 is disposed between the whole valve sealing opening 15 and the primary valve sealing opening 16 and a primary outlet channel 18 is disposed behind the primary valve sealing opening 16 and communicated to the primary air outlet 13, and a secondary outlet channel 19 is disposed behind the primary valve sealing opening 16 and communicated to the secondary air outlet 14. In this embodiment, a first secondary channel 19' is also disposed behind the primary valve sealing opening 16 and communicated to the first secondary air outlet 14', and a second secondary channel 19" is disposed behind the primary valve sealing opening 16 and communicated to the second secondary air outlet 14", and the first auxiliary valve sealing opening 17' is disposed in the first secondary channel 19', and the second auxiliary valve sealing opening 17" is disposed in the second secondary channel 19", and the whole solenoid valve 2 is provided for opening and closing the gas intake of the whole valve sealing opening 15, and the primary divided solenoid valve 3 is provided for opening and closing the gas intake of the primary valve sealing opening 16, and the first auxiliary divided solenoid valve 4' is provided for opening and closing the gas intake of the first auxiliary valve sealing opening 17', and the second auxiliary divided solenoid valve 4" is provided for opening and closing the gas intake of the second auxiliary valve sealing opening 17".

The primary outlet channel 18 has a primary regulating port 110 formed thereon, and the secondary outlet channel 19 has a secondary regulating port 111 formed thereon. In this embodiment, the first secondary outlet channel 19' also has a first secondary regulating port 111' formed thereon, and the second secondary outlet channel 19" has a second secondary regulating port 111" formed thereon, and the primary regulating port 110, the first secondary regulating port 111' and the second secondary regulating port 111" are configured uniformly around the flow regulating mechanism 5, and the primary valve sealing opening 16 is communicated directly to the primary regulating port 110, the first secondary regulating port 111', and the second secondary regulating port 111", and the primary regulating port 110 is communicated directly to the primary air outlet 13, and the first secondary regulating port 111' is communicated to the first secondary air outlet 14' through the first auxiliary valve sealing opening 17', and the second secondary regulating port 111" is communicated to the second secondary air outlet 14" through the second auxiliary valve sealing opening 17". The flow regulating mechanism 5 comprises a plunger rod 51, a press plate 52, and an adjustment rod 53 disposed at the primary regulating port 110, the first secondary regulating port 111' and the second secondary regulating port 111" separately, wherein the tail of the adjustment rod 53 is contacted with an adjustment rod indenter 54 of the press plate 52, and a resetting device 55 is installed between each adjustment rod 53 and the valve body 1. In this embodiment, the resetting device 55 is a compression spring installed in the flow regulating mechanism 5. At an initial state, the press plate 52 presses the adjustment rods 53 in the primary regulating port 110, the first secondary regulating port 111' and the second secondary regulating port 111" simultaneously by the adjustment rod indenter 54, and the openings formed by the heads of the adjustment rods 53 and the primary regulating port 110, the first secondary regulating port 111' and the second secondary regulating port 111" are situated at a maximum open status. When it is necessary to regulate the gas flow, the plunger rod 51 is pushed upward to compress the press plate 52, so as to loosen the adjustment rod 53. Under the action of the resetting device 55, the openings formed by the heads of the adjustment rods 53 and the primary regulating port 110, the first secondary regulating port 111' and the second secondary regulating port 111" are reduced until they are closed, so as to regulate the gas flow passing through the primary regulating port 110, the first secondary regulating port 111' and the second secondary regulating port 111".

In this embodiment as shown in FIGS. 11 to 15, a low-level outlet channel is formed in each outlet channel including the primary outlet channel 18, the first secondary outlet channel 19' and the second secondary outlet channel 19", and a primary low-level outlet channel 112, a first secondary low-level outlet channel 113' and a second secondary low-level outlet channel 113" are formed and configured to be parallel to the primary regulating port 110, the first secondary regulating port 111' and the second secondary regulating port 111" respectively, and each low-level outlet channel further comprises a low-level regulating plug including a primary low-level regulating plug 6, a first secondary low-level regulating plug 7' and a second secondary low-level regulating plug 7", and the primary low-level regulating plug 6 is installed in the primary low-level outlet channel 112, and the first secondary low-level regulating plug 7' is installed in the first secondary low-level outlet channel 113', and the second secondary low-level regulating plug 7" is installed in the second secondary low-level outlet channel 113", and the primary low-level regulating plug 6, the first secondary low-level regulating plug 7' and the second secondary low-level regulating plug 7" have a primary low-level regulating seal ring 61, a first secondary low-level regulating seal ring 71' and a second secondary low-level regulating seal ring 71" installed thereon respectively and provided for sealing the primary low-level regulating plug 6, the first secondary low-level regulating plug 7', and the second secondary low-level regulating plug 7" to the valve body 1, and the heads of the primary low-level regulating plug 6, the first secondary low-level regulating plug 7', and the second secondary low-level regulating plug 7" are configured to be a primary low-level regulating plug conical head 62, a first secondary low-level regulating plug conical head 72', and a second secondary low-level regulating plug conical head 72", and the primary low-level regulating plug 6, the first secondary low-level regulating plug 7', and the second secondary low-level regulating plug 7" are coupled to the valve body by a threaded connection, so that the size of the openings formed by the primary low-level regulating plug 6 and the primary low-level outlet channel 112, the first secondary low-level regulating plug 7' and the first secondary low-level outlet channel 113' and the second secondary low-level regulating plug 7" and the second secondary low-level outlet channel 113" can be adjusted manually to change the gas flow passing through the primary low-level outlet channel 112, the first secondary low-level outlet channel 113' and the second secondary low-level outlet channel 113". According to the layout requirements of the valve body, the airflow directions at the primary low-level outlet channel 112, the first secondary low-level outlet channel 113' and the second secondary low-level outlet channel 113" with respect to the primary low-level regulating plug conical head 62, the first secondary low-level regulating plug conical head 72', and the second secondary low-level regulating plug conical head 72" are different in this embodiment.

Figure 1:
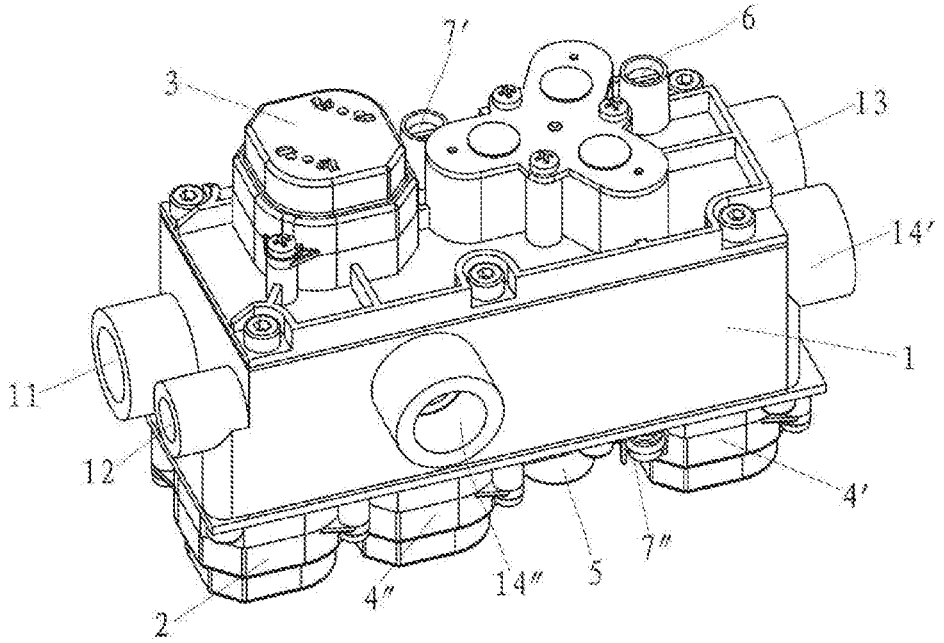
FIG. 1 is a perspective view of a first embodiment of the present invention.
Figure 2:
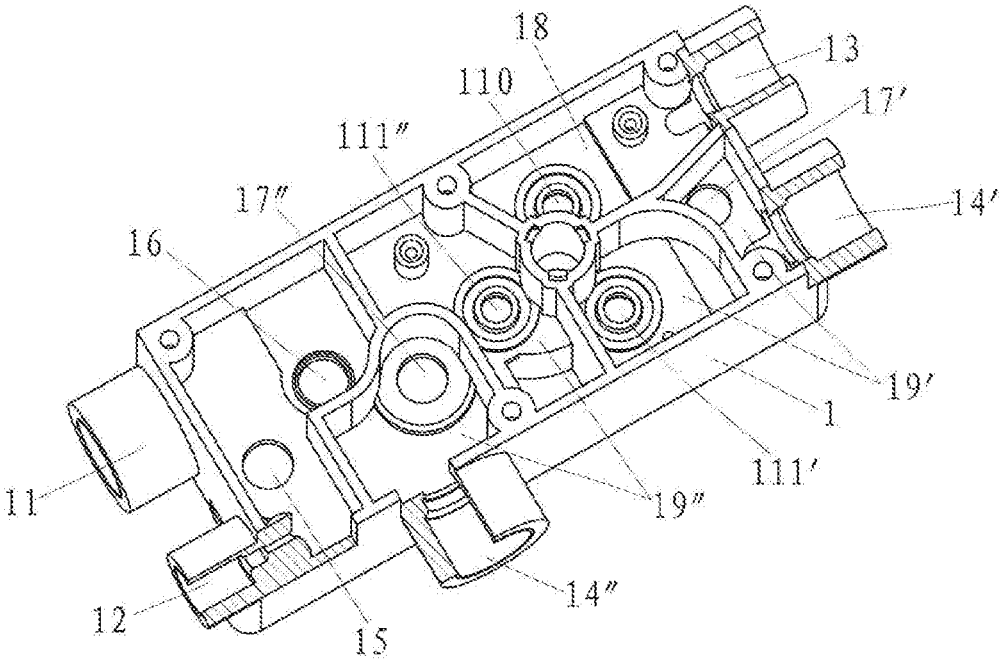
FIG. 2 is a schematic view of a valve body in accordance with the first embodiment of the present invention.
Figure 3:
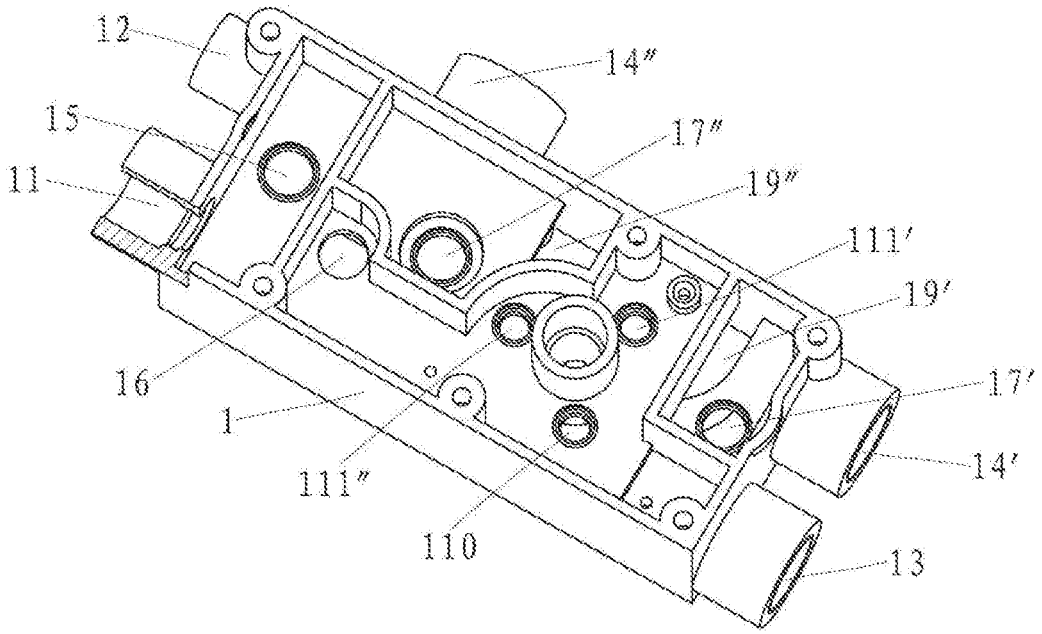
FIG. 3 is a schematic view showing another side of the valve body in accordance with the first embodiment of the present invention.
Figure 4:
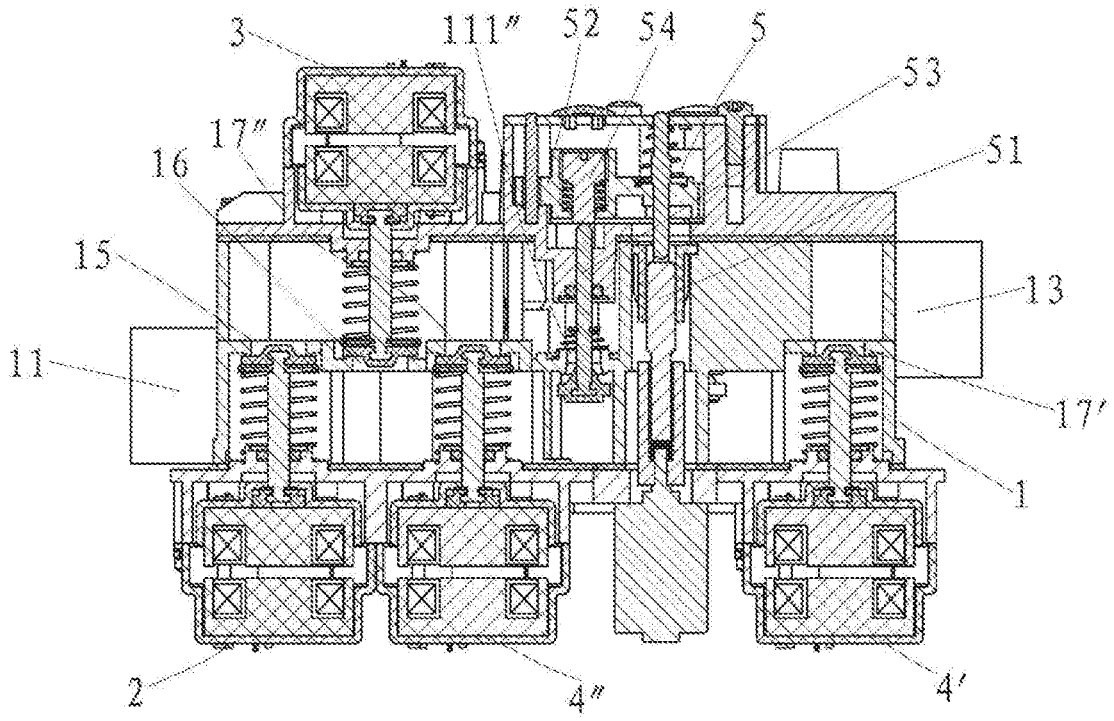
FIG. 4 is a stepped sectional view showing an initial position of the first embodiment of the present invention.
Figure 5:
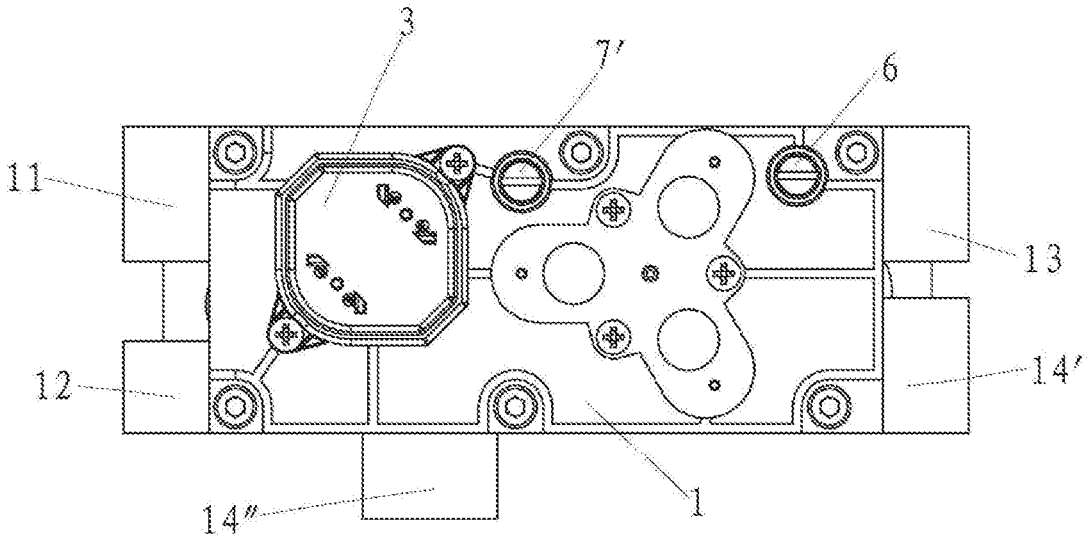
FIG. 5 is a top view of the first embodiment of the present invention.
Figure 6:
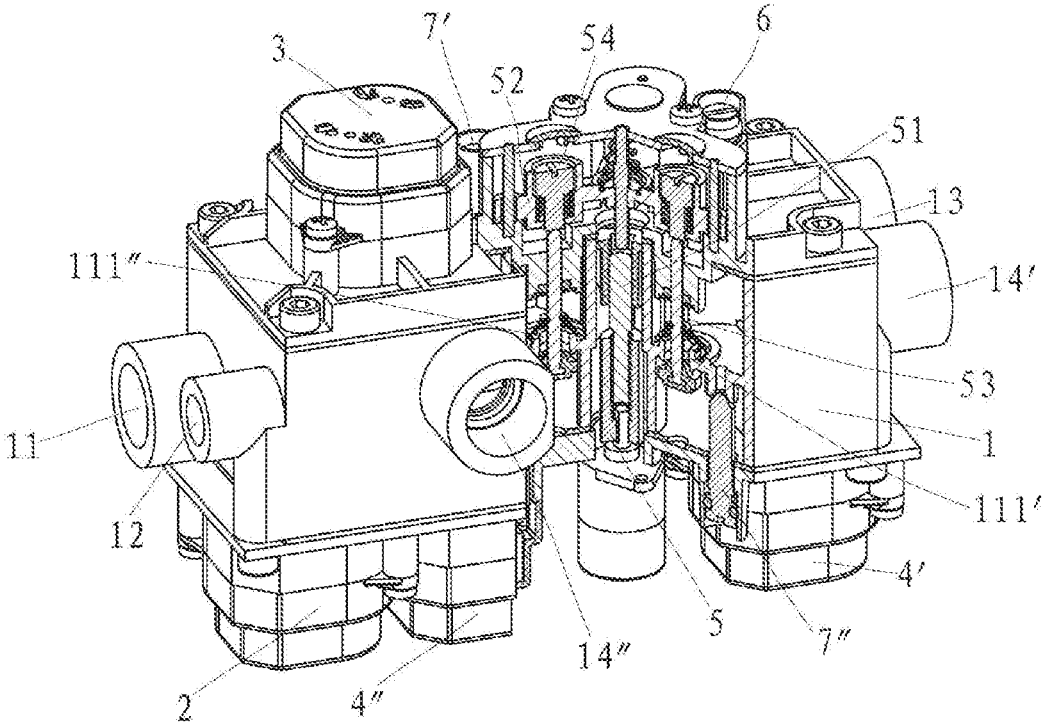
FIG. 6 is an axial-side partial sectional view of the first embodiment of the present invention.
Figure 7:
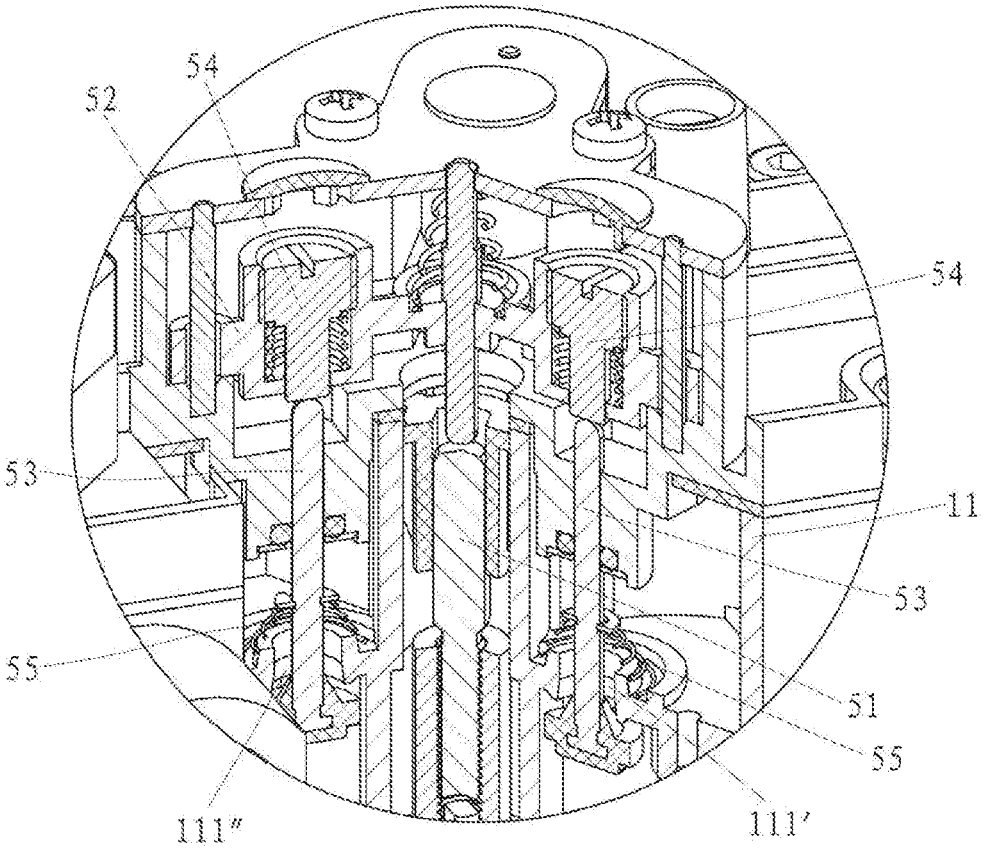
FIG. 7 is a schematic blowup view of a flow regulating mechanism in accordance with the first embodiment of the present invention.
Figure 8:
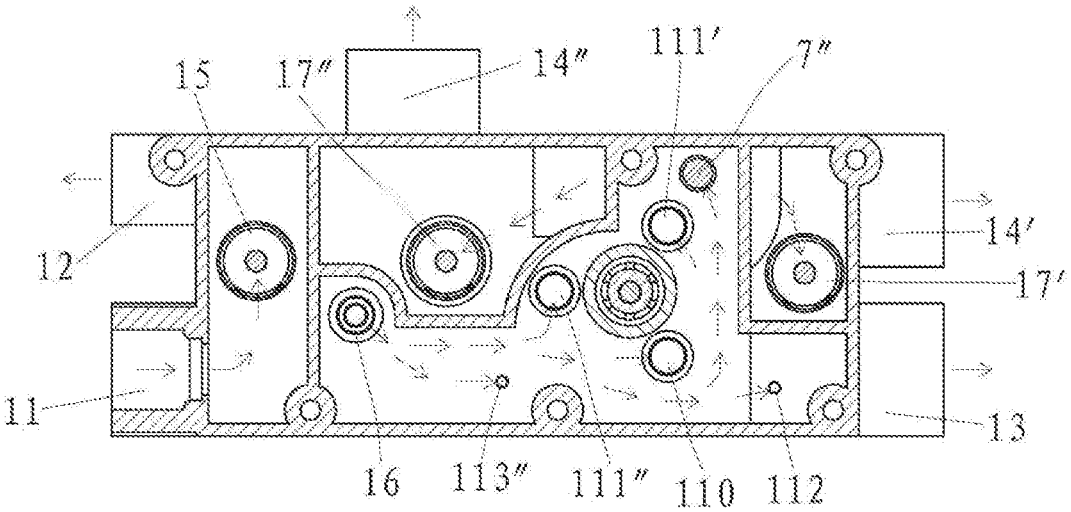
FIG. 8 is a transverse cross-sectional view showing an air inlet in accordance with the first embodiment of the present invention.
Figure 9:
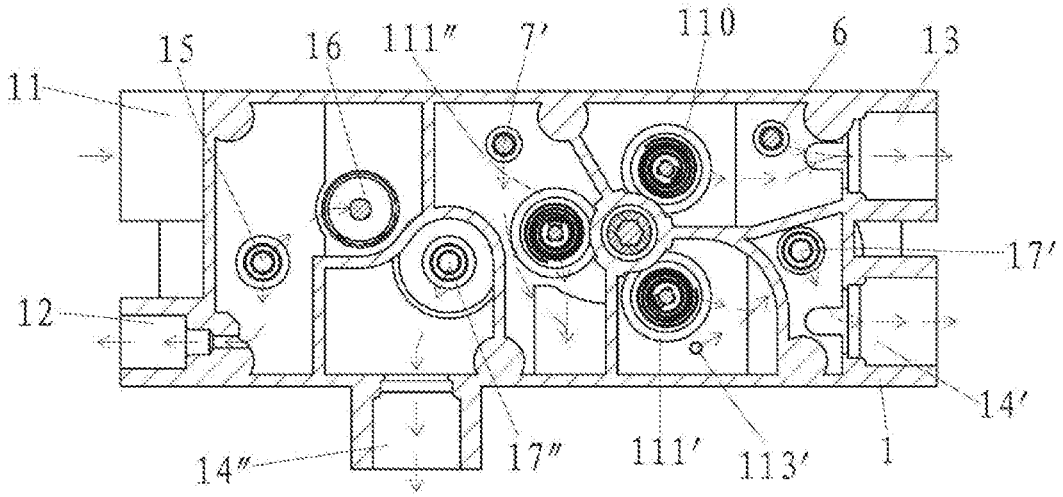
FIG. 9 is a transverse cross-sectional view showing a plurality of air outlets in accordance with the first embodiment of the present invention.
Figure 10:
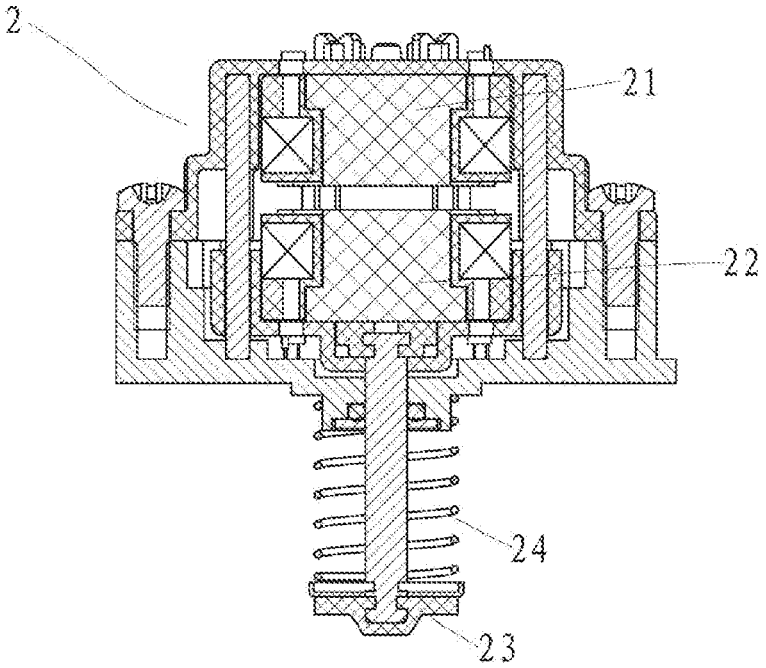
FIG. 10 is a schematic blowup view of a solenoid valve in accordance with the first embodiment of the present invention.
Figure 11:
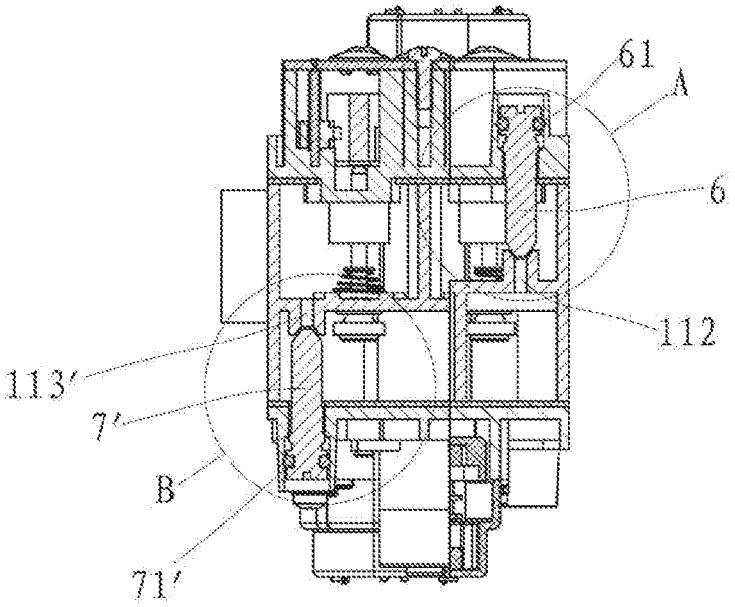
FIG. 11 is a stepped sectional view showing a primary low-level regulating plug and a first secondary low-level regulating plug in accordance with the first embodiment of the present invention.
Figure 12:
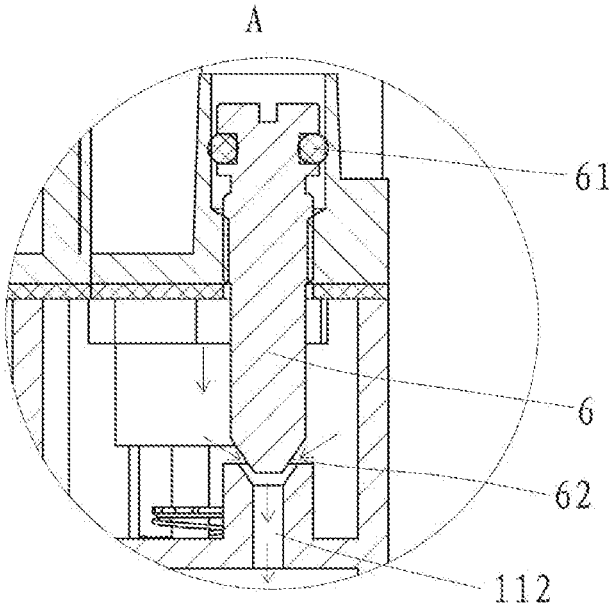

In FIG. 10, the whole solenoid valve 2 is of a dual-coil electromagnet structure, and the whole solenoid valve 2 comprises a solenoid valve static coil assembly 21 and a solenoid valve dynamic coil assembly 22, and the solenoid valve dynamic coil assembly 22 is coupled to the solenoid valve gasket 23, and the solenoid valve gasket 23 is made of rubber, so that the solenoid valve gasket 23 can seal the whole valve sealing opening 15 under the action of the solenoid valve spring 24. In actual practices, the solenoid valve gasket 23 and the whole valve sealing opening 15 are situated at a sealed status under the action of the solenoid valve spring 24 at the initial state. When it is necessary to open the whole valve sealing opening 15, a larger current is passed through the solenoid valve static coil assembly 21 and the solenoid valve dynamic coil assembly 22 to pull in the solenoid valve dynamic coil assembly 22 and the solenoid valve static coil assembly 21 and compress the solenoid valve spring 24, and open the solenoid valve gasket 23, so as to open the whole valve sealing opening 15. Immediately after the solenoid valve dynamic coil assembly 22 and the solenoid valve static coil assembly 21 are pulled in, the current in the solenoid valve static coil assembly 21 and/or the solenoid valve dynamic coil assembly 22 may be reduced, and it is just necessary to supply a smaller current or even maintain a small current passing through one of the coils only in order to maintain the solenoid valve dynamic coil assembly 22 and the solenoid valve static coil assembly 21 at their pull-in status.

Similarly, the primary divided solenoid valve 3, the first auxiliary divided solenoid valve 4' and the second auxiliary divided solenoid valve 4" have a structure similar to the dual-coil electromagnet structure of the whole solenoid valve 2, and thus the description of the structure will not be repeated.

Wherein, the whole solenoid valve 2 and the primary divided solenoid valve 3 are provided for opening and closing the gas intake of the whole channel, and thus playing the role of safety protection, and the first auxiliary divided solenoid valve 4' and the second auxiliary divided solenoid valve 4" are provided for controlling whether or not to discharge gas from the first secondary air outlet 14' and the second air outlet 14", so as to control the operation of the burners coupled to the first secondary air outlet 14' and the second air outlet 14" respectively.

Embodiment 2

With reference to FIGS. 16 to 28 for a multi-outlet channel combination gas valve in accordance with the second embodiment of the present invention, the multi-outlet channel combination gas valve comprises a valve body 1, a solenoid valve, and a flow regulating mechanism 5, characterized in that there are three solenoid valves called a whole solenoid valve 2, a primary divided solenoid valve 3 and an auxiliary divided solenoid valve 4 respectively according to the effect of each solenoid valve in the gas path, wherein both of the primary divided solenoid valve 3 and the auxiliary divided solenoid valve 4 are divided solenoid valves, and the valve body 1 comprises an air inlet 11 and a pilot air outlet 12 as well as a plurality of air outlets which are divided into a primary air outlet 13 and two secondary air outlets 14 according to the outlet control method of each air outlet. In this embodiment, only one secondary air outlet 14 is provided, and there is only one auxiliary divided solenoid valve 4 correspondingly. The valve body 1 comprises a whole valve sealing opening 15, a primary valve sealing opening 16 and an auxiliary valve sealing opening 17, and the pilot air outlet 12 is disposed between the whole valve sealing opening 15 and the primary valve sealing opening 16, and a primary outlet channel 18 is disposed behind the primary valve sealing opening 16 and communicated to the primary air outlet 13, and a secondary outlet channel 19 is disposed behind the primary valve sealing opening 16 and communicated to the secondary air outlet 14, and the auxiliary valve sealing opening 17 is disposed in the secondary outlet channel 19, and the whole solenoid valve 2 is provided for opening and closing the gas intake of the whole valve sealing opening 15, and the primary divided solenoid valve 3 is provided for opening and closing the gas intake of the primary valve sealing opening 16, and the auxiliary divided solenoid valve 4 is provided for opening and closing the gas intake of the auxiliary valve sealing opening 117.

The primary outlet channel 18 has a primary regulating port 110 formed thereon, and the secondary outlet channel 119 has a secondary regulating port 111 formed thereon. The primary regulating port 110 and the secondary regulating port 111 are disposed at symmetrical positions around the flow regulating mechanism 5. The primary valve sealing opening 16, the primary regulating port 110, and the secondary regulating port 111 are communicated directly to each other, and the primary regulating port 110 is communicated directly to the primary air outlet 13, and the secondary regulating port 111 is communicated to the secondary air outlet 14 through the auxiliary valve sealing opening 17. The flow regulating mechanism 5 comprises a plunger rod 51, a press plate 52, and an adjustment rod 53 disposed at the primary regulating port 110, the first secondary regulating port 111' and the second secondary regulating port 111" separately, wherein the tail of the adjustment rod 53 is contacted with an adjustment rod indenter 54 of the press plate 52, and a resetting device 55 is installed between each adjustment rod 53 and the valve body 1. In this embodiment, the resetting device 55 is a compression spring installed in the flow regulating mechanism 5. At an initial state, the press plate 52 presses the adjustment rods 53 in the primary regulating port 110, and the second secondary regulating port 111 simultaneously by the adjustment rod indenter 54, and the openings formed by the heads of the adjustment rods 53 and the primary regulating port 110, and the secondary regulating port 111 are situated at a maximum open status. When it is necessary to regulate the gas flow, the plunger rod 51 is pushed upward to compress the press plate 52, so as to loosen the adjustment rod 53. Under the action of the resetting device 55, the openings formed by the heads of the adjustment rods 53 and the primary regulating port 110 and the secondary regulating port 111 are reduced until they are closed, so as to regulate the gas flow passing through the primary regulating port 110 and the secondary regulating port 111.

In this embodiment as shown in FIGS. 25 to 28, a low-level outlet channel is formed in each outlet channel including the primary outlet channel 18 and the secondary outlet channel 19, and a primary low-level outlet channel 112 and a secondary low-level outlet channel 113 are formed and configured to be parallel to the primary regulating port 110 and the secondary regulating port 111 respectively, and each low-level outlet channel further comprises a low-level regulating plug including a primary low-level regulating plug 6 and a secondary low-level regulating plug 7, and the primary low-level regulating plug 6 is installed in the primary low-level outlet channel 112, and the secondary low-level regulating plug 7 is installed in the secondary low-level outlet channel 113, and the primary low-level regulating plug 6 and the secondary low-level regulating plug 7 have a primary low-level regulating seal ring 61 and a secondary low-level regulating seal ring 71 disposed thereon respectively for sealing the primary low-level regulating plug 6 and the secondary low-level regulating plug 7 to the valve body 1, and the heads of the primary low-level regulating plug 6 and the secondary low-level regulating plug 7 are configured to be a primary low-level regulating plug conical head 62 and a secondary low-level regulating plug conical head 72 respectively, and the primary low-level regulating plug 6 and the secondary low-level regulating plug 7 are coupled to the valve body 1 by a threaded connection, so that the size of the openings formed by the primary low-level regulating plug 6 and the primary low-level outlet channel 112, and the secondary low-level regulating plug 7 and the secondary low-level outlet channel 113 can be adjusted manually to change the gas flow passing through the primary low-level outlet channel 112 and the secondary low-level outlet channel 113. According to the layout requirements of the valve body, the airflow directions at the primary low-level outlet channel 112, the first secondary low-level outlet channel 113 with respect to the primary low-level regulating plug conical head 62, the first secondary low-level regulating plug conical head 72 are the same in this embodiment.

In FIG. 24, the whole solenoid valve 2 is of a dual-coil electromagnet structure, and the whole solenoid valve 2 comprises a solenoid valve static coil assembly 21 and a solenoid valve dynamic coil assembly 22, and the solenoid valve dynamic coil assembly 22 is coupled to the solenoid valve gasket 23, and the solenoid valve gasket 23 is made of rubber, so that the solenoid valve gasket 23 can seal the whole valve sealing opening 15 under the action of the solenoid valve spring 24. In actual practices, the solenoid valve gasket 23 and the whole valve sealing opening 15 are situated at a sealed status under the action of the solenoid valve spring 24 at the initial state. When it is necessary to open the whole valve sealing opening 15, a larger current is passed through the solenoid valve static coil assembly 21 and the solenoid valve dynamic coil assembly 22 to pull in the solenoid valve dynamic coil assembly 22 and the solenoid valve static coil assembly 21 and compress the solenoid valve spring 24, and open the solenoid valve gasket 23, so as to open the whole valve sealing opening 15. Immediately after the solenoid valve dynamic coil assembly 22 and the solenoid valve static coil assembly 21 are pulled in, the current in the solenoid valve static coil assembly 21 and/or the solenoid valve dynamic coil assembly 22 may be reduced, and it is just necessary to supply a smaller current or even maintain a small current passing through one of the coils only in order to maintain the solenoid valve dynamic coil assembly 22 and the solenoid valve static coil assembly 21 at their pull-in status.

Similarly, the primary divided solenoid valve 3 and the auxiliary divided solenoid valve 4 have a structure similar to the dual-coil electromagnet structure of the whole solenoid valve 2, and thus the description of the structure will not be repeated.

Wherein, the whole solenoid valve 2 and the primary divided solenoid valve 3 are provided for opening and closing the gas intake of the whole channel, and thus playing the role of safety protection, and the primary divided solenoid valve further can control whether or not to discharge gas from the primary air outlet 13 and the secondary air outlet 14, and the auxiliary divided solenoid valve 4 can control whether or not to discharge gas from the secondary air outlet 14, so as to control the operation of the burners coupled to the secondary air outlet 14.

Embodiment 3

With reference to FIGS. 29 to 39 for a multi-outlet channel combination gas valve in accordance with the third embodiment of the present invention, the multi-outlet channel combination gas valve comprises a valve body 1, a solenoid valve, and a flow regulating mechanism 5, characterized in that there are three solenoid valves called a whole solenoid valve 2, a primary divided solenoid valve 3, and a valve body 1 according to the effect of each solenoid valve in the gas path, and the valve body 1 comprises an air inlet 11 and a pilot air outlet 12 as well as a plurality of air outlets which are called a first primary air outlet 13' and a second primary air outlet 13" in this embodiment for convenience, and primary divided solenoid valve 3 is also divided into a first primary divided solenoid valve 3' and a second primary divided solenoid valve 3". The valve body 1 comprises a whole valve sealing opening 15, a first primary valve sealing opening 16' and a second primary valve sealing opening 16", and the pilot air outlet 12 is disposed behind the whole valve sealing opening 15 and in front of the first primary valve sealing opening 16' and the second primary valve sealing opening 16", and the first primary valve sealing opening 16' and the second primary valve sealing opening 16" are communicated directly to the whole valve sealing opening 15, and a first primary outlet channel 18' is disposed behind the first primary valve sealing opening 16' and communicated to the first primary air outlet 13', and a second secondary outlet channel 18" is disposed behind the second primary valve sealing opening 16" and communicated to the second primary air outlet 13". The whole solenoid valve 2 is provided for opening and closing the gas intake of the whole valve sealing opening 15, and the first primary divided solenoid valve 3' is provided for opening and closing the gas intake of the first primary valve sealing opening 16', and the second primary divided solenoid valve 3" is provided for opening and closing the gas intake of the second primary valve sealing opening 16".

The first primary outlet channel 18' has a first primary regulating port 110' formed thereon, and the second primary outlet channel 18" has a second primary regulating port 110" formed thereon, and the first primary regulating port 110' and the second primary regulating port 110" are disposed at symmetrical positions around the flow regulating mechanism 5. The first primary valve sealing opening 16' is coupled to the first primary air outlet 13' through first primary regulating port 110', and the second primary valve sealing opening 16" is coupled to the second primary air outlet 13" through the second primary air outlet 13". The flow regulating mechanism 5 comprises a plunger rod 51, a press plate 52, and an adjustment rod 53 disposed in the first primary regulating port 110' and the second primary regulating port 110" separately, wherein the tail of the adjustment rod 53 is contacted with an adjustment rod indenter 54 of the press plate 52, and a resetting device 55 is installed between each adjustment rod 53 and the valve body 1. In this embodiment, the resetting device 55 is a compression spring installed in the flow regulating mechanism 5. In the third embodiment, the resetting device 55 is a compression spring. At an initial state, the press plate 52 in the flow regulating mechanism 5 presses the adjustment rods 53 in the first primary regulating port 110' and the second primary regulating port 110" simultaneously by the adjustment rod indenter 54, and the openings formed by the heads of the adjustment rods 53 and the first primary regulating port 110' and the second primary regulating port 110" are situated at a maximum open status. When it is necessary to regulate the gas flow, the plunger rod 51 is pushed upward to compress the press plate 52, so as to loosen the adjustment rod 53. Under the action of the resetting device 55, the openings formed by the heads of the adjustment rods 53 and the first primary regulating port 110' and the second primary regulating port 110" are reduced until they are closed, so as to regulate the gas flow passing through the first primary regulating port 110' and the second primary regulating port 110".

In this embodiment as shown in FIGS. 38 and 39, a low-level outlet channel is formed in each outlet channel including the first primary outlet channel 18' and the second outlet channel 18", and a first primary low-level outlet channel 112' and a second primary low-level outlet channel 112" are formed and configured to be parallel to the first primary regulating port 110' and the second primary regulating port 110", and each low-level outlet channel further comprises a low-level regulating plug including a first primary low-level regulating plug 6' and a second primary low-level regulating plug 6", and the first primary low-level regulating plug 6' is installed in the first primary low-level outlet channel 112', and the second primary low-level regulating plug 6" is installed in the second primary low-level outlet channel 112", and the first primary low-level regulating plug 6' and the second primary low-level regulating plug 6" have a first primary low-level regulating seal ring 61' and a second primary low-level regulating seal ring 61" disposed thereon respectively for sealing the first primary low-level regulating plug 6' and the second primary low-level regulating plug 6" to the valve body 1, and the heads of the first primary low-level regulating plug 6' and the second primary low-level regulating plug 6" are configured to be a first primary low-level regulating plug conical head 62' and a second primary low-level regulating plug conical head 72" respectively, and the first primary low-level regulating plug 6' and the second primary low-level regulating plug 6" are coupled to the valve body 1 by a threaded connection, so that the size of the openings formed by the first primary low-level regulating plug 6' and the first primary low-level outlet channel 112', and the second primary low-level regulating plug 6" and the second primary low-level outlet channel 112" can be adjusted manually to change the gas flow passing through the first primary low-level outlet channel 112' and second primary low-level outlet channel 112". According to the layout requirements of the valve body, the airflow directions of the first primary low-level outlet channel 112' and the second primary low-level outlet channel 112" with respect to the first primary low-level regulating plug conical head 62' and the second low-level regulating plug conical head 62" are the same in this embodiment.

The whole solenoid valve 2 is of a dual-coil electromagnet structure, and the whole solenoid valve 2 comprises a solenoid valve static coil assembly 21 and a solenoid valve dynamic coil assembly 22, and the solenoid valve dynamic coil assembly 22 is coupled to the solenoid valve gasket 23, and the solenoid valve gasket 23 is made of rubber, so that the solenoid valve gasket 23 can seal the whole valve sealing opening 15 under the action of the solenoid valve spring 24. In actual practices, the solenoid valve gasket 23 and the whole valve sealing opening 15 are situated at a sealed status under the action of the solenoid valve spring 24 at the initial state. When it is necessary to open the whole valve sealing opening 15, a larger current is passed through the solenoid valve static coil assembly 21 and the solenoid valve dynamic coil assembly 22 to pull in the solenoid valve dynamic coil assembly 22 and the solenoid valve static coil assembly 21 and compress the solenoid valve spring 24, and open the solenoid valve gasket 23, so as to open the whole valve sealing opening 15. Immediately after the solenoid valve dynamic coil assembly 22 and the solenoid valve static coil assembly 21 are pulled in, the current in the solenoid valve static coil assembly 21 and/or the solenoid valve dynamic coil assembly 22 may be reduced, and it is just necessary to supply a smaller current or even maintain a small current passing through one of the coils only in order to maintain the solenoid valve dynamic coil assembly 22 and the solenoid valve static coil assembly 21 at their pull-in status.

Similarly, the first primary divided solenoid valve 3' and the second primary divided solenoid valve 3" have a structure similar to the dual-coil electromagnet structure of the whole solenoid valve 2, and thus the description of the structure will not be repeated.

Wherein, the whole solenoid valve 2 is provided for opening and closing the gas intake of the whole channel, and thus playing the role of safety protection, and the first primary divided solenoid valve 3' is provided for controlling whether or not to discharge gas from the first primary air outlet 13', and the second primary divided solenoid valve 3" is provided for controlling whether or not to discharge gas from the second primary air outlet 13", so as to control the operation of the burners coupled to the corresponding air outlet.

While the invention has been described by means of specific embodiments, numerous modifications and variations could be made thereto by those skilled in the art without departing from the scope and spirit of the invention set forth in the claims.

What is claimed is:

1. A multi-outlet channel combination gas valve, comprising:

a valve body, a solenoid valve, and a flow regulating mechanism, wherein the valve body comprises an air inlet and a plurality of air outlets, wherein at least two outlet channels are formed between the plurality of air outlets and the air inlet, each of the two outlet channels includes a regulating port, each regulating port is disposed around the flow regulating mechanism, and the flow regulating mechanism is capable of controlling the gas flow of each regulating port at the same time.

2. The multi-outlet channel combination gas valve of claim 1, wherein the valve body further comprises a valve sealing opening disposed at the air inlet, and a gas has to pass through the valve sealing opening in order to flow from the air inlet to each air outlet, and the solenoid valve is provided for opening and closing a gas intake of the valve sealing opening, and the configuration and assembly of the solenoid valve in the valve body is capable of controlling the opening and closing of the gas intake of the outlet channels in the valve body.

3. The multi-outlet channel combination gas valve of claim 1, wherein at least one of the at least two outlet channels has a low-level outlet channel disposed therein and is configured to be parallel to the regulating port in the at least one of the two outlet channels.

4. The multi-outlet channel combination gas valve of claim 3, wherein the low-level outlet channel has a low-level regulating plug installed therein, and coupled to the valve body by a threaded connection, and the low-level regulating plug includes a tail having a shape for screwing the low-level regulating plug into a certain depth of valve body manually by a tool.

5. The multi-outlet channel combination gas valve of claim 1, wherein the flow regulating mechanism has a plunger rod and a press plate, and each regulating port has an adjustment rod installed therein, and the press plate has an adjustment rod indenter disposed thereon and configured to be corresponsive to at least one of the adjustment rods, and the adjustment rod indenter includes a head that contacts the tail of the adjustment rod, and a resetting device is installed between the adjustment rod and the valve body, and the plunger rod is pushed to regulate the gas flow passing through each regulating port at the same time.

6. The multi-outlet channel combination gas valve of claim 5, wherein the head of the adjustment rod indenter is capable of adjusting the height with respect to a surface of the press plate.

7. The multi-outlet channel combination gas valve of claim 1, wherein the solenoid valve is of a dual-coil electromagnet structure, and the solenoid valve comprises a solenoid valve static coil assembly and a solenoid valve dynamic coil assembly, and a gasket is installed onto the solenoid valve and coupled to the solenoid valve dynamic coil assembly, and a solenoid valve spring is installed between the gasket and the solenoid valve dynamic coil assembly.

8. The multi-outlet channel combination gas valve of claim 1, wherein the valve body has a pilot air outlet formed thereon, and the solenoid valve is one of a plurality of solenoid valves, wherein the plurality of solenoid valves includes a whole solenoid valve and at least one divided solenoid valve, and the pilot air outlet is disposed at the whole solenoid valve, and the whole solenoid valve is capable of controlling the opening and closing of the gas intake of the pilot air outlet and the air outlets.

9. The multi-outlet channel combination gas valve of claim 4, wherein the low-level regulating plug has a low-level regulating plug seal ring, and the low-level regulating plug includes a low-level regulating plug conical head.

* * * * *